US011165166B2

(12) United States Patent
Yman et al.

(10) Patent No.: US 11,165,166 B2
(45) Date of Patent: Nov. 2, 2021

(54) ANTENNA FEEDING NETWORK

(71) Applicant: CELLMAX TECHNOLOGIES AB, Kista (SE)

(72) Inventors: Niclas J. Yman, Ekero (SE); Dan Karlsson, Sollentuna (SE); Stefan Jonsson, Sollentuna (SE)

(73) Assignee: CELLMAX TECHNOLOGIES AB, Kista (SE)

( * ) Notice: Subject to any disclaimer, the term of this patent is extended or adjusted under 35 U.S.C. 154(b) by 72 days.

(21) Appl. No.: 16/797,676

(22) Filed: Feb. 21, 2020

(65) Prior Publication Data

US 2020/0259262 A1 Aug. 13, 2020

Related U.S. Application Data

(63) Continuation of application No. 16/544,867, filed on Aug. 19, 2019, now Pat. No. 10,573,971, which is a (Continued)

(30) Foreign Application Priority Data

Sep. 15, 2015 (SE) ..... 1551183-5
Sep. 15, 2015 (SE) ..... 1551184-3
Sep. 15, 2015 (SE) ..... 1551186-8

(51) Int. Cl.
*H01Q 21/00* (2006.01)
*H01Q 21/08* (2006.01)
(Continued)

(52) U.S. Cl.
CPC ..... *H01Q 21/0006* (2013.01); *H01P 5/026* (2013.01); *H01P 5/04* (2013.01);
(Continued)

(58) Field of Classification Search
CPC ..... H01Q 1/50; H01Q 1/246; H01Q 3/32; H01Q 3/30; H01Q 9/16; H01Q 19/108;
(Continued)

(56) References Cited

U.S. PATENT DOCUMENTS 5,801,600 A 9/1998 Butland et al.
6,683,582 B1 1/2004 Love
(Continued)

FOREIGN PATENT DOCUMENTS

CN 102714354 A 10/2012
EP 0575808 A1 12/1993
(Continued)

OTHER PUBLICATIONS

PCT/SE2016/050863, International Search Report, dated Dec. 16, 2016, Patent-och registreringsverket Box 5055 S-102 42 Stockholm, Sweden.
(Continued)

*Primary Examiner* — Robert Karacsony
(74) *Attorney, Agent, or Firm* — The Jansson Firm; Pehr B. Jansson

(57) ABSTRACT

An antenna feeding network for a multi-radiator antenna. The feeding network comprises at least one substantially air filled coaxial line, each comprising a central inner conductor, an elongated outer conductor surrounding the central inner conductor and an elongated rail element slidably movably arranged inside the outer conductor. The rail element is longitudinally movable in relation to at least the outer conductor.

12 Claims, 11 Drawing Sheets

Related U.S. Application Data continuation of application No. 15/760,594, filed as application No. PCT/SE2016/050867 on Sep. 15, 2016, now Pat. No. 10,389,039, said application No. 16/544,867 is a continuation of application No. 15/760,201, filed as application No. PCT/SE2016/050863 on Sep. 15, 2016, now Pat. No. 10,424,843, said application No. 16/544,867 is a continuation of application No. 15/760,609, filed as application No. PCT/SE2016/050868 on Sep. 15, 2016, now Pat. No. 11,050,161.

(51) Int. Cl.

| | |
|---|---|
| ***H01Q 1/24*** | (2006.01) |
| ***H01P 5/04*** | (2006.01) |
| ***H01P 5/02*** | (2006.01) |
| ***H01P 5/103*** | (2006.01) |
| ***H01Q 1/50*** | (2006.01) |
| ***H01Q 9/16*** | (2006.01) |
| ***H01Q 19/10*** | (2006.01) |
| ***H01P 3/06*** | (2006.01) |
| ***H01Q 3/30*** | (2006.01) |
| ***H01Q 21/26*** | (2006.01) |

(52) U.S. Cl.

CPC ..... *H01P 5/103* (2013.01); *H01Q 1/246* (2013.01); *H01Q 1/50* (2013.01); *H01Q 9/16* (2013.01); *H01Q 19/108* (2013.01); *H01Q 21/08* (2013.01); *H01P 3/06* (2013.01); *H01Q 3/30* (2013.01); *H01Q 21/26* (2013.01)

(58) Field of Classification Search

CPC .... H01Q 21/0006; H01Q 21/08; H01Q 21/26; H01Q 21/0025; H01P 1/183; H01P 3/06; H01P 5/026; H01P 5/103; H01P 5/12; H01P 5/183; H01P 5/04

See application file for complete search history.

(56) References Cited

U.S. PATENT DOCUMENTS

| | | | |
|---|---|---|---|
| 2001/0048351 | A1 | 12/2001 | Love |
| 2002/0135520 | A1 | 9/2002 | Teillet et al. |
| 2002/0135527 | A1 | 9/2002 | Teillet et al. |
| 2004/0203284 | A1 | 10/2004 | Stolle et al. |
| 2004/0263389 | A1 | 12/2004 | Haunberger et al. |
| 2005/0134517 | A1 | 6/2005 | Gottl |
| 2007/0241984 | A1 | 10/2007 | Schadler |
| 2008/0139044 | A1 | 6/2008 | Hantsch et al. |
| 2010/0001811 | A1 | 1/2010 | Haunberger et al. |
| 2010/0007571 | A1 | 1/2010 | Riedel |
| 2010/0201590 | A1 | 8/2010 | Girard et al. |
| 2010/0283710 | A1 | 11/2010 | Lutman et al. |
| 2013/0088402 | A1 | 4/2013 | Lindmark et al. |
| 2014/0035698 | A1 | 2/2014 | Schadler et al. |
| 2014/0139387 | A1 | 5/2014 | Jones et al. |
| 2015/0109183 | A1 | 4/2015 | Smith |
| 2015/0180135 | A1 | 6/2015 | Jonsson et al. |

FOREIGN PATENT DOCUMENTS

| | | | |
|---|---|---|---|
| KR | 20100117838 | A | 11/2010 |
| WO | WO8605325 | A1 | 9/1986 |
| WO | WO02067374 | A1 | 8/2002 |
| WO | WO2005060049 | A1 | 10/2005 |
| WO | WO2005101566 | A1 | 10/2005 |
| WO | WO2006006913 | A1 | 1/2006 |
| WO | WO2009041896 | A1 | 4/2009 |
| WO | WO2012003506 | A2 | 1/2012 |
| WO | WO2012103821 | A2 | 8/2012 |
| WO | WO2014120062 | A1 | 8/2014 |
| WO | WO2017048181 | A1 | 3/2017 |
| WO | WO2017048182 | A1 | 3/2017 |

OTHER PUBLICATIONS

PCT/SE2016/050863, Written Opinion of the International Searching Authority, dated Dec. 16, 2016, Patent-och registreringsverket Box 5055 S-102 42 Stockholm, Sweden.

PCT/SE2017/050087, International Search Report, dated May 4, 2017, Patent-och registreringsverket Box 5055 S-10242 Stockholm, Sweden.

PCT/SE2017/050087, Written Opinion of the International Searching Authority, dated May 4, 2017, Patent-och registreringsverket Box 5055 S-10242 Stockholm, Sweden.

PCT/SE2017/050088, International Search Report, dated Apr. 28, 2017, Patent-och registreringsverket Box 5055 S-10242 Stockholm, Sweden.

PCT/SE2017/050088, Written Opinion of the International Searching Authority, dated Apr. 28, 2017, Patent-och registreringsverket Box 5055 S-10242 Stockholm, Sweden.

PCT/SE2017/050618, International Search Report, dated Aug. 30, 2017, Patent-och registreringsverket Box 5055 S-10242 Stockholm, Sweden.

PCT/SE2017/050618, Written Opinion of the International Searching Authority, dated Aug. 30, 2017, Patent-och registreringsverket Box 5055 S-10242 Stockholm, Sweden.

PCT/SE2016/050864, International Search Report, dated Nov. 30, 2016, Patent-och registreringsverket Box 5055 S-10242 Stockholm, Sweden.

PCT/SE2016/050864, Written Opinion of the International Searching Authority, dated Nov. 30, 2016, Patent-och registreringsverket Box 5055 S-10242 Stockholm, Sweden.

PCT/SE2016/050867, International Search Report, dated Dec. 14, 2016, Patent-och registreringsverket Box 5055 S-10242 Stockholm, Sweden.

PCT/SE2016/050867, Written Opinion of the International Searching Authority, dated Dec. 14, 2016, Patent-och registreringsverket Box 5055 S-10242 Stockholm, Sweden.

PCT/SE2016/050868, International Search Report, dated Dec. 16, 2016, Patent-och registreringsverket Box 5055 S-10242 Stockholm, Sweden.

PCT/SE2016/050868, Written Opinion of the International Searching Authority, dated Dec. 16, 2016, Patent-och registreringsverket Box 5055 S-10242 Stockholm, Sweden.

ANTENNA FEEDING NETWORK

FIELD OF THE INVENTION

The invention relates to the field of antenna feeding networks for multi-radiator antennas, which feeding network comprises at least one coaxial line.

BACKGROUND

Multi-radiator antennas are frequently used in for example cellular networks. Such multi-radiator antennas comprise a number of radiating antenna elements for example in the form of dipoles for sending or receiving signals, an antenna feeding network and an electrically conductive reflector. The antenna feeding network distributes the signal from a common coaxial connector to the radiators when the antenna is transmitting and combines the signals from the radiators and feeds them to the coaxial connector when receiving. A possible implementation of such a feeding network is shown in FIG. 1.

In such a network, if the splitters/combiners consist of one junction between e.g. 3 different 50 ohm lines, impedance match would not be maintained, and the impedance seen from each port would be 25 ohm instead of 50 ohm. Therefore the splitter/combiner usually also includes an impedance transformation circuit which maintains 50 ohm impedance at all ports.

A person skilled in the art would recognize that the feeding is fully reciprocal in the sense that transmission and reception can be treated in the same way, and to simplify the description of this invention only the transmission case is described below.

The antenna feeding network may comprise a plurality of coaxial lines being substantially air filled, each coaxial line comprising a central inner conductor at least partly surrounded by an outer conductor with insulating air in between. The coaxial lines may be parallel. The coaxial lines and the reflector may be formed integrally with each other in the sense that the outer conductors and the reflector are formed in one piece. The splitting may be done via crossover connections between inner conductors of adjacent coaxial lines.

Antenna feeding networks of the closed type are known, i.e. feeding networks where the outer conductor in each coaxial line forms a cavity around the central inner conductor, i.e. encircles or forms a closed loop around the central inner conductor as seen in a cross section perpendicular to the longitudinal direction of the coaxial line, see FIG. 2. One disadvantage with such a closed antenna feeding network is that it may be difficult to assemble the antenna, e.g. properly arranging the central inner conductors and associated components such as support means for holding the inner conductors and connection means between the inner conductors inside the outer conductors. Furthermore, if movable dielectric elements are provided between the outer and inner conductors to provide a phase shifting functionality, the positions of such dielectric elements are not easily adjustable due to the closed outer conductors.

Antenna feeding networks of the open type are also known, i.e. feeding networks where the outer conductors in at least some coaxial lines are provided with openings, and thus do not completely surround or encircle the inner conductors. One example of such a feeding network is disclosed in WO2005/101566 in which an antenna feeding network having coaxial lines with a longitudinally extending opening along one side of the outer conductor, see FIG. 3.

The inner conductors are supported by dielectric support means. Pairs of adjacent inner conductors may be interconnected by cross-over elements, which are arranged in openings through the wall between the inner conductors. This feeding network solves some of the problems associated with the closed type feeding network, in particular it is easier to assemble since direct access to the interior of the coaxial lines is provided. On the other hand, the longitudinally extending openings makes the antenna less mechanically stable and unwanted backwardly directed radiation may occur. Such unwanted radiation may reduce the antenna performance in terms of e.g. back- or sidelobe suppression. In antennas having two cross-polarized channels, it may also reduce cross-polarisation isolation and also isolation between the two channels. All those antenna parameters may be important to the performance of e.g. a cellular network in terms of e.g. interference and fading reduction. The problem with unwanted radiation may be solved at least in part by additional components in the form of conductive covers to cover the cross-over elements. Using such covers add to the cost and complexity of the feeding network however.

US 2013/01355166 A1 discloses an antenna arrangement comprising an antenna feeding network including at least one antenna feeding line comprising a coaxial line having a central inner conductor and a surrounding outer conductor. The inner conductor is suspended inside the outer conductor with the help of dielectric support means. US 2013/0135166 A1 suggests to use a crossover element to connect two inner conductors of two adjacent coaxial lines. The crossover element is galvanically connected to the inner conductors by means of for example screws, soldering, gluing or a combination thereof, and thus a direct physical contact between the electrically conductive inner conductor and the crossover element is established. Where two conductors need to be connected, the wall between the two coaxial lines is partially or completely removed, and the crossover element is placed in the opening. The antenna arrangement according to US 2013/0135166 has the disadvantage that it may be difficult and time consuming to assemble or manufacture. A further disadvantage with this arrangement is that the mechanical connection formed by the screwed, glued or soldered connection between the lines may introduce passive intermodulation (PIM).

In order to preserve the characteristic impedance, the lines connecting to the crossover element include impedance matching structures. The substantially air filled coaxial lines may be provided with a dielectric element to provide a phase shifting arrangement. The phase shift is achieved by moving the dielectric element that is located between the inner conductor and the outer conductor of a coaxial line. If the dielectric element is moved in such a way that the outer conductor will be more filled with dielectric material, the phase shift will increase. WO2009/041896 discloses an antenna arrangement provided with an adjustable differential phase shifter using such a movable dielectric element.

The radiating element is typically a dipole. A dipole usually may consist of two radiating parts having an electrical length of approximately one quarter of a wavelength at the operating frequency and extending essentially in plane parallel with the antenna reflector, and positioned approximately at a distance equivalent to one quarter of a wavelength at the operating frequency. The radiating parts are fed in counter-phase. Such a feeding is achieved by using a balanced-unbalanced transformer, also called a balun. In a dipole, it is often convenient to also use the balun as a mechanical support of the two radiating parts. The balun is often also used as an impedance matching element.

The balun consists of a body part and a coupling element which can also be seen as a conductor positioned in the centre of a cylindrical hole in the body part. The balun coupling element is electrically connected at one end to one of the radiating elements, and at the other end to a feeding line inner conductor.

The body part is usually connected to feeding line outer conductor and to the antenna reflector.

The connection between the radiating element and one of the inner conductors may be achieved using for example a screw joint. Thus, direct contact between the electrically conductive coupling element of the radiating element and an electrically conductive portion of the inner conductor is established. Such an arrangement has the disadvantage that it may be difficult and time consuming to assemble or manufacture since a screwed connection may be difficult to achieve in the very limited space available inside the outer conductor. Also, the screw and the coupling element are often inserted from opposite sides of the antenna which makes assembly difficult. Another disadvantage with the screw joint is that it may introduce passive intermodulation (PIM). Due to the small dimensions of the coupling element of the radiating element, the screw joint also needs to be of small dimensions, which makes it particularly difficult to achieve a connection which is sufficiently firm to avoid PIM.

SUMMARY

An object of the present invention is to overcome at least some of the disadvantages of the prior art described above.

These and other objects are achieved by the present invention by means of an antenna feeding network that in one aspect comprises at least one coaxial line and in another aspect comprises at least two coaxial lines, and a method for manufacturing such a coaxial line(s), and a multi radiator antenna comprising such an antenna feeding network according to the independent claims. Preferred embodiments are defined in the dependent claims.

According to a first aspect of the invention, an antenna feeding network for a multi-radiator base station antenna is provided. The antenna feeding network may comprise at least two coaxial lines. Each coaxial line comprises a central inner conductor and an elongated outer conductor surrounding the central inner conductor. At least a first inner conductor and a second inner conductor of the at least two coaxial lines are indirectly interconnected.

The feeding network comprises at least one or a plurality of substantially air filled coaxial line(s), each coaxial line comprising a central inner conductor, an elongated outer conductor surrounding the central inner conductor and an elongated rail element slidably or movably arranged inside the outer conductor. The rail element is longitudinally movable in relation to at least the outer conductor. The coaxial lines are preferably parallel.

In other words, the feeding network comprises at least one substantially air filled coaxial line, each comprising an inner conductor centrally arranged in an elongated outer conductor with air in-between, where each central inner conductor is at least partly surrounded by the corresponding outer conductor. Each outer conductor is formed by the walls defining an elongated compartment, the walls being made in a conductive material such as aluminum. The inner conductor and the rail element are thus arranged in the elongated compartment. The central inner conductor(s) may be substantially surrounded by the corresponding outer conductor in the sense that one or more openings are provided in the outer conductor, which may be small openings with limited extension in the longitudinal direction of the coaxial line, provided for example to allow electrical connection(s) to the inner conductor. In embodiments, the central inner conductor(s) may be encircled or completely surrounded by the outer conductor in the sense that the outer conductor forms a closed loop around the inner conductor as seen in a cross section perpendicular to the longitudinal direction of the coaxial line. The antenna feeding network may thus be of the closed type. The air between the conductors replaces the dielectric often found in coaxial cables between the inner and outer conductor. The outer conductor may in embodiments be a tube-shaped element having a square cross section. Further, the elongated rail element may be described as a bar-shaped element, i.e. an element which is substantially longer than wide, which is also wider than thick. It is understood that the term substantially air filled is used to described that the coaxial line is provided not solely with air in between the outer and inner conductors, but also with an elongated rail element which occupies part of the space inside the outer conductor which would otherwise be filled with air. In embodiments described below, the antenna feeding network may be provided with further components inside the outer conductor such as support elements and dielectric elements which also occupies part of the space inside the outer conductor which would otherwise be filled with air. The coaxial line is thus substantially, but not completely air filled in these embodiments. It is furthermore understood that although the antenna feeding network comprises at least one coaxial line provided with a rail element, the antenna feeding network may comprise further coaxial line(s) without such rail element(s).

According to a second aspect of the invention, a multi radiator antenna is provided. The multi radiator antenna comprises an antenna feeding network according to the first aspect of the invention, a reflector and a plurality of radiating elements such as dipoles arranged on said reflector.

According to a third aspect of the invention, a method for manufacturing a coaxial line for a multi-radiator base station antenna feeding network is provided. The method comprises providing a central inner conductor, an elongated outer conductor, and an elongated rail element adapted to be slidably movable inside the outer conductor. The method further comprises arranging the central inner conductor on the elongated rail element. The method further comprises sliding the elongated rail element with the inner conductor arranged thereon into the outer conductor such that the outer conductor together with the inner conductor form a substantially air filled coaxial line.

The invention is based on the insight that the disadvantages associated with the prior art may be overcome by providing each coaxial line with an elongated rail element which is movably arranged inside the outer conductor of the coaxial line. This allows the rail element to support the central inner conductor (at least) during assembly of the antenna feeding network such that the central inner conductor and, optionally other associated components, may be easily inserted or removed from the outer conductor.

In embodiments, at least one, or each, coaxial line of said at least one coaxial line is provided with at least one support element configured to support the central inner conductor, the support element being located between the outer and inner conductors. The rail element may be arranged inside the outer conductor in such a manner that the support element(s) is located between the rail element and the inner conductor. The support element(s) may not necessarily be in abutment or contact with the rail when the feeding network has been assembled. On the contrary, the support element(s)

may be at a small distance from the rail element after assembly to avoid any friction there between when the rail is moved. The support element(s) may be supported by the outer conductor to define the positional relationship between the inner and outer conductors. During or prior to assembly or manufacturing however, the support element(s) may be placed on the rail element, i.e. in direct contact therewith.

It is understood that the directions referred to in this application relate to an antenna feeding network and multi-radiator base station antenna where a plurality of coaxial lines are arranged side by side in parallel to each other and also in parallel with a reflector on which the radiating elements are arranged. Longitudinally in this context refers to the lengthwise direction of the coaxial lines, and sideways refers to a direction perpendicular to the lengthwise direction of the coaxial lines. It is also understood that the term encircle used herein refers in general to completely surrounding an object, and is not limited to a circular surrounding shape.

In embodiments, the at least one support element is fixed in a longitudinal direction relative to the inner conductor. The support element may further be configured to position the inner conductor relative the outer conductor. This may be achieved for example by adapting the size of the support element to the inner dimensions of the outer conductor such that the support element is in direct contact with the inner and outer conductors when the antenna feeding network is assembled.

In embodiments, at least one dielectric element is provided to at least partially fill the space between the inner and outer conductors in at least one of the coaxial lines to co-operate with the at least one coaxial line. The at least one dielectric element is attached to an elongated rail element arranged in the at least one coaxial line. In other words, one or a plurality of elongated rail elements may each be provided with one or a plurality of dielectric elements attached thereto. At least one elongated rail element may thus be provided with at least two dielectric elements being attached thereto, which dielectric elements are spaced apart from each other (as seen in the longitudinal direction). Preferably, at least two rail elements are each provided with at least one dielectric element, wherein at least one of these rail elements is provided with at least two dielectric elements. These embodiments are advantageous since they allow the position(s) of the dielectric element(s) to be conveniently adjusted by moving the rail element(s). The at least one dielectric element may act to co-operate with the at least one coaxial line to provide a phase shifting arrangement.

The phase shift is achieved by moving the dielectric element that is located between the inner conductor and the outer conductor of the coaxial line. It is a known physical property that introducing a material with higher permittivity than air in a transmission line will reduce the phase velocity of a wave propagating along that transmission line. This can also be perceived as delaying the signal or introducing a phase lag compared to a coaxial line that has no dielectric material between the inner and outer conductors. If the dielectric element is moved in such a way that the outer conductor will be more filled with dielectric material, the phase shift will increase. The at least one dielectric element may have a U-shaped profile such as to partly surround the inner conductor in order to at least partly fill out the cavity between the inner and outer conductors.

In embodiments, the feeding network comprises at least two, or a plurality of, substantially air filled coaxial lines, each comprising a central inner conductor and an elongated outer conductor surrounding the central inner conductor. The outer conductor is formed by the walls defining an elongated compartment, the walls being made in a conductive material such as aluminum. At least one of the coaxial lines, or each coaxial line, comprise an elongated rail element slidably arranged inside the outer conductor, i.e. within the compartment, the rail element being longitudinally movable in relation to the conductors. The inner conductors of at least two coaxial lines may be interconnected by means of a connector device. At least one rail element is provided with at least one dielectric element being attached thereto. A splitter/combiner with differential phase shift may be achieved by means of a pair of interconnected coaxial lines provided with a rail element with a dielectric element in at least one of the coaxial lines, where the phase shift is adjustable by moving the rail element.

In embodiments, the feeding network comprises at least two, or a plurality of, substantially air filled coaxial lines formed using a common elongated compartment, the walls defining the elongate compartment being used as outer conductors which each surrounds a respective inner conductor. The inner conductors are arranged consecutively and at a distance from each other (as seen in the longitudinal direction of the outer conductor) therein. A common elongated rail element is slidably arranged within the compartment, and is provided with at least two dielectric elements, each being configured to co-operate with a corresponding inner conductor of the at least two coaxial lines formed within the common compartment to form at least two phase shifting arrangements. It is understood that the at least two phase shifting arrangements comprising dielectric elements attached to the common rail element move synchronously when the rail is moved, thus resulting in equal phase shift in the corresponding at least two coaxial lines.

The two embodiments described above are advantageously combined to form a feeding network having at least four coaxial lines. The first and second coaxial lines each comprise a central inner conductor arranged in an elongated compartment, the walls defining the elongate compartment being used as an outer conductor surrounding the central inner conductor. An elongated rail element is slidably arranged within the compartment of the second coaxial line, and optionally also in the first coaxial line. The rail element in the second coaxial line may be provided with a dielectric element to provide a phase shift arrangement. The third and fourth coaxial lines are formed using a common elongated compartment as described above and a common elongated rail element provided with at least two dielectric elements to form second and third phase shifting arrangements. Connector devices are provided between the first and second coaxial lines and between the second coaxial line and each of the third and fourth coaxial lines to provide a feeding network which distributes a signal to/from the first coaxial line to the ends of the third and fourth coaxial lines, to which four radiators or dipoles are connectable. In further embodiments, the feeding network may comprise an additional common compartment provided with four inner conductors and an elongated rail element therein to form fifth, sixth, seventh and eighth coaxial lines, connectable to eight dipoles. The corresponding rail element may, but does not necessarily need to be, provided with at least four dielectric elements therein to provide further phase shifting arrangements. In yet other embodiments, the feeding network comprises yet another common compartment provided with eight inner conductors, connectable to sixteen dipoles, and optionally yet another common compartment provided with sixteen inner conductors, connectable to thirtytwo dipoles.

In embodiments, the outer conductor is provided with guiding means configured to guide the rail element inside the outer conductor. The guiding means may comprise at least one longitudinally extending protrusion, ridge or groove provided on the inside or inner wall(s) of the outer conductor. For example, the guiding means may comprise one ridge on each inner side wall of the outer conductor arranged at a distance from the bottom surface of the outer conductor, which ridges extend in parallel along the whole or essentially the whole length of the outer conductor, such that the rail element is guided from below by the bottom surface and from above by the ridges. Alternatively, the guiding means may comprise pairs of ridges on each inner side wall, which ridges extend in parallel along the whole or essentially the whole length of the outer conductor, such that the rail element is guided between the ridges.

In an antenna arrangement, the radiators may be positioned in a vertical column. The electrical antenna tilt angle is determined by the relative phases of the signals feeding the radiators. The relative phases can be fixed giving the antenna a predetermined tilt angle, or the relative phases can be variable if a variable tilt angle is required. In embodiments of the antenna feeding network, it is provided with means to achieve more phase shift in one coaxial line than in another, i.e. to control the relative phases, in order to control the electrical antenna tilt angle.

This may be achieved by having dielectric elements of different sizes, and/or by moving the rails and corresponding dielectric elements at different relative speeds, and/or by using dielectric elements with different dielectric constants. In such an embodiment, the antenna feeding network may comprise a plurality of air filled coaxial lines and means for moving at least two rail elements of the coaxial lines simultaneously at different speeds. Because the rail elements and the dielectric elements attached thereto move at different speed, and/or because the dielectric elements are of different sizes and/or have different dielectric constants, more phase shift will be achieved in at least one of the coaxial lines than in at least one other of the coaxial lines. The means for moving may comprise a longitudinally extending rod and at least first and second connecting elements, each connecting element being connected to a corresponding rail element, each connecting element being provided with an internally threaded portion, the internally threaded portions being configured to co-operate with corresponding (externally) threaded segments or portions of the rod, wherein the threaded segments or portions of the rod have different pitch from each other such that the first and second connecting elements move at different speed when the rod is rotated. In other words, the internally threaded portion of the first connecting element has a first pitch and is engaged with a first threaded segment on the rod having the first pitch, and the internally threaded portion of the second connecting element has a second pitch, which is different from the first pitch, and is engaged with a second threaded segment on the rod having the second pitch.

The means for moving may further comprise means for manually rotating said longitudinally extending rod, for example a handle or knob, such that the rod may be rotated or actuated by hand. Alternatively, the means for moving may comprise at least one electric motor arranged to rotate said longitudinally extending rod and optionally also means for electrically controlling said electric motor from a distance. This is advantageous since it is possible to remotely change the position of the dielectric elements, thus remotely controlling the downtilt of the antenna.

In embodiments, the antenna feeding network is provided with at least one holding element configured to attach or fixate the inner conductor to the outer conductor. The holding element may be of the type described in applicants co-pending application titled "Antenna feeding network comprising at least one holding element".

In further embodiments, an electrically conductive reflector is integrally formed with the outer conductors of the coaxial lines.

In embodiments, each inner conductor is fixedly arranged inside the corresponding outer conductor or compartment.

All embodiments described above may also form parts of embodiments of a multi radiator antenna according to the second aspect of the invention.

In embodiments of a method according the third aspect of the invention, the method is for manufacturing an antenna feeding network according to the first aspect of the invention or embodiments thereof, which method comprises performing the steps of providing, arranging and sliding at least one time to provide the at least one substantially air filled coaxial line. Further embodiments of the method comprises performing steps to achieve features corresponding to any of the above described embodiments of the antenna feeding network.

In further embodiments of the method, the step of arranging comprises arranging the central inner conductor on said elongated rail element at a distance therefrom using at least one support element. In yet further embodiments, the method comprises providing at least one dielectric element and attaching the at least one dielectric element to the elongated rail element. In yet further embodiments of the method, the method comprises the steps of providing at least one holding element, and, after the step of sliding, attaching the inner conductor to the outer conductor by means of the holding element.

According to a fourth aspect of the invention, an antenna feeding network for a multi-radiator antenna is provided, the antenna feeding network comprising at least two coaxial lines. Each coaxial line comprises a central inner conductor and an elongated outer conductor surrounding the central inner conductor. At least a first inner conductor and a second inner conductor of the at least two coaxial lines are indirectly interconnected.

In other words, the antenna feeding network comprises at least a first coaxial line and a second coaxial line, wherein the first coaxial line comprises a first inner conductor and an elongated outer conductor surrounding the first inner conductor, and wherein the second coaxial line comprises a second inner conductor and an elongated outer conductor surrounding the second inner conductor. The first inner conductor, the second inner conductor, and optionally further inner conductors, are indirectly interconnected or interconnectable. The coaxial lines may be parallel.

The invention is based on the insight that an antenna feeding network which is easy to assemble, yet provides high performance and low passive intermodulation, may be achieved by indirectly interconnecting inner conductors of the coaxial lines instead of connecting the inner conductors galvanically. Such an indirect interconnection, i.e. capacitive or inductive interconnection or a combination of the two, between the lines may provide an interconnection which does not suffer from the disadvantages associated with mechanical/galvanical connections discussed above.

It is understood that coaxial line refers to an arrangement comprising an inner conductor and an outer conductor with insulating or dielectric material or gas there between, where the outer conductor is coaxial with the inner conductor in the sense that it completely or substantially surrounds the inner conductor. Thus, the outer conductor does not necessarily have to surround the inner conductor completely, but may be provided with openings or slots, which slots may even extend along the full length of the outer conductor.

The at least two coaxial lines may each be provided with air between the inner and outer conductors. The air between the inner and outer conductors thus replaces the dielectric often found in coaxial cables.

In embodiments, at least one, or each, coaxial line of said at least two coaxial lines is provided with at least one support element configured to support the central inner conductor, the support element being located between the outer and inner conductors.

In embodiments, at least one, or each, coaxial line of said at least two coaxial lines is furthermore provided with at least one dielectric element to at least partially fill the cavity between the inner and outer conductors. Such dielectric element(s) is/are preferably slidably movable inside the outer conductor(s) to co-operate with the coaxial line(s) to provide a phase shifting arrangement. The phase shift is achieved by moving the dielectric element that is located between the inner conductor and the outer conductor of the coaxial line. It is a known physical property that introducing a material with higher permittivity than air in a transmission line will reduce the phase velocity of a wave propagating along that transmission line. This can also be perceived as delaying the signal or introducing a phase lag compared to a coaxial line that has no dielectric material between the inner and outer conductors. If the dielectric element is moved in such a way that the outer conductor will be more filled with dielectric material, the phase shift will increase. The at least one dielectric element may have a U-shaped profile such as to partly surround the inner conductor in order to at least partly fill out the cavity between the inner and outer conductors.

In embodiments, two of said at least two coaxial lines form a splitter/combiner. When operating as a splitter, the inner conductor of a first coaxial line is part of the incoming line, and the two ends of the inner conductor of the second coaxial line are the two outputs of the splitter. Thus, the second coaxial line forms two outgoing coaxial lines. In such an embodiment, the dielectric element may be arranged in the second coaxial line in such a way that by moving the dielectric part different amount of dielectric material is present in the respective outgoing coaxial lines. Such an arrangement allows the differential phase of the outputs of a splitter to be varied by adjusting the position of the dielectric part within the splitter. A reciprocal functionality will be obtained when the coaxial line functions as a combiner. Such splitters/combiners having variable differential phase shifting capability are advantageously used in an antennas having radiators positioned in a vertical column, to adjust the electrical antenna tilt angle by adjusting the relative phases of the signals feeding the radiators.

In embodiments where the coaxial line(s) is/are provided with support element(s), dielectric element(s) or other components inside the outer conductor(s), the coaxial line(s) may be described as substantially air filled since these components occupy part of the space inside the outer conductor which would otherwise be filled with air.

In embodiments, the antenna feeding network comprises a connector device configured to indirectly interconnect the at least first and second inner conductors.

Herein the word indirectly means that conductive material of the connector device is not in direct physical contact with the conductive material of the first inner conductor and the second inner conductor, respectively. Indirectly thus means an inductive, a capacitive coupling or a combination of the two.

In embodiments, there may be at least one insulating layer arranged in between the conductive material of the connector device and the conductive material of the inner conductor. This at least one insulating layer may be arranged on the connector device and thus belong to the connector device and/or it may be arranged on the first inner conductor or on the second inner conductor or on both inner conductors. The at least one insulating layer may alternatively comprise a thin film which is arranged between the conductive material of the connector device and the conductive material of the inner conductor. The at least one insulating layer may also be described as an insulating coating. The insulating layer or insulating coating may be made of an electrically insulating material such as a polymer material or a non-conductive oxide material with a thickness of less than 50 μm, such as from 1 μm to 20 μm, such as from 5 μm to 15 μm, such as from 8 μm to 12 μm. Such a polymer or oxide layer may be applied with known processes and high accuracy on the connector device and/or on the inner conductor(s).

In embodiments, the connector device may be configured to be removably connected to the first inner conductor and the second inner conductor. This allows a quick reconfiguration of the antenna feeding network, if necessary or can be used for trouble-shooting in antenna production.

In preferred embodiments, the connector device may be realized as a snap on element comprising at least one pair of snap on fingers and a bridge portion, whereby the snap on fingers may be connected to the bridge portion and wherein the snap on fingers are configured to be snapped onto the first or the second inner conductor. The bridge portion may be configured to connect with the other of the first or the second inner conductor, which is not engaged by the pair of snap on fingers, when the snap on element is snapped onto the first or second inner conductor. The snap on element may comprise two pairs of snap on fingers which are connected by the bridge portion, wherein the two pairs of snap on fingers may be configured to be snapped onto the first inner conductor and the second inner conductor, respectively. These preferred embodiments are advantageous since they allow convenient assembly of the antenna feeding network, where the connector device is simply snapped onto the first and/or second inner conductors. The connector device may also be arranged with two or more bridge portions, connecting three or more pairs of snap on fingers.

In an alternative embodiment, one of the inner conductors comprises a cavity and another of the inner conductors comprises a rod-shaped protrusion configured to extend into and engage with said cavity. An insulating layer is provided in said cavity and/or on said rod-shaped protrusion, or alternatively, an insulating layer is provided as an insulating film between the cavity and the rod-shaped protrusion. Thus, an indirect connection may be provided between two inner conductors. These embodiments are advantageous since they allow convenient assembly of the antenna feeding network, where the inner conductors are interconnected simply by pushing the rod-shaped protrusion into the cavity. Also, this arrangement will reduce the risk for PIM. The cavity may have a depth corresponding to a quarter wavelength.

In yet an alternative embodiment, the connector device comprises at least two engaging portions. Each of the at least first and second inner conductors comprises corresponding engaging portions, each adapted to engage with a corresponding engaging portion of the connector device. The engaging portion is in the form of a cavity or rod-shaped protrusion. An insulating layer is provided in said cavity and/or on said rod-shaped protrusion, or alternatively, an insulating layer is provided as an insulating film between the cavity and the rod-shaped protrusion. Thus, an indirect connection may be provided between two inner conductors. The connector device may in embodiments be provided with three legs, each being provided with an engaging portion at its end to interconnect three inner conductors. For example, the connector device may be provided with cavities at each end of the legs, and three inner conductors may be provided with rod-shaped protrusions adapted to fit and engage in a respective cavity. The cavity or cavities may have a depth corresponding to a quarter wavelength. The connector device may also be arranged such as to connect four or more inner conductors.

The embodiments described above may be combined in any practically realizable way.

According to a fifth aspect of the invention, a multi radiator base station antenna is provided, which antenna comprises an electrically conductive reflector, at least one radiating element arranged on the reflector and an antenna feeding network as described above.

In an embodiment of the multi-radiator antenna according to the fifth aspect of the invention, the electrically conductive reflector may comprise at least one opening on the front side or the back side, so that the connector device can be installed on the first and second inner conductor via said opening. The opening may advantageously be adapted to the size of the connector device. An opening may be assigned to each inner conductor pair of the antenna feeding network so that all inner conductors in the electrically conductive reflector may be connected by connector devices.

According to a sixth aspect of the invention, a method for assembling an antenna feeding network for a multi-radiator antenna is provided. The method comprises providing at least two coaxial lines, wherein each coaxial line is provided with a central inner conductor and an elongated outer conductor surrounding the central inner conductor, and interconnecting at least two inner conductors of the coaxial lines indirectly.

In an embodiment of the method according to the sixth aspect of the invention, the method further comprises providing a connector device, and providing an insulating layer on the connector device and/or on the at least first and second conductors. Alternatively, an insulating layer is provided between the connector device and said at least first and second conductors. The embodiment further comprises connecting the connector device between the at least first and second inner conductors, wherein the connector device preferably is realized as a snap on element comprising snap on fingers adapted to be snapped onto the at least first and second inner conductors.

In embodiments of a method according the sixth aspect of the invention, the method is for assembling an antenna feeding network according to the fourth aspect of the invention or embodiments thereof. Embodiments of the method comprises performing steps to achieve features corresponding to any of the above described embodiments of the antenna feeding network.

According to a seventh aspect of the invention, an antenna arrangement comprising an antenna feeding network, an electrically conductive reflector and at least one radiating element arranged on said reflector is provided. The antenna feeding network comprises at least one substantially air filled coaxial line, each coaxial line comprising a central inner conductor and an elongated outer conductor at least partly surrounding the central inner conductor, wherein the at least one radiating element and at least one coaxial line are configured to interconnect indirectly.

In other words, one or a plurality of radiating elements, for example dipoles, are configured to connect electrically in an indirect manner with at least one coaxial line to achieve electrical connection for signals to/from the radiating element(s).

The invention is based on the insight that an antenna arrangement which is easy to assemble, yet provides high performance and low passive intermodulation, may be achieved by indirectly interconnecting at least one radiating element with a corresponding coaxial line, instead of connecting them galvanically. Such an indirect interconnection, i.e. capacitive or inductive interconnection or a combination of the two, between the radiating elements and the coaxial lines may provide an interconnection which may not suffer from the disadvantages associated with mechanical/galvanical connections discussed above.

Herein the word indirectly means that electrically conductive material of the radiating elements and coaxial lines are not in direct physical contact with each other, i.e. are non-galvanically connected. Indirectly thus means an inductive coupling, a capacitive coupling or a combination of the two.

It is understood that coaxial line refers to an arrangement comprising an inner conductor and an outer conductor with insulating or dielectric material or gas there between, where the outer conductor is coaxial with the inner conductor in the sense that it completely or substantially surrounds the inner conductor. Thus, the outer conductor does not necessarily have to surround the inner conductor completely, but may be provided with openings or slots, which slots may even extend along the full length of the outer conductor.

As described above, the at least one coaxial line is substantially air filled in the sense that each coaxial line is provided with air between the inner and outer conductors. The air between the inner and outer conductors thus replaces the dielectric often found in coaxial cables. In embodiments described below, the antenna feeding network may be provided with further components inside the outer conductor such as connector elements, support elements and dielectric elements which also occupies part of the space inside the outer conductor which would otherwise be filled with air. The coaxial line is thus substantially, but not completely, air filled in these embodiments.

In embodiments, the at least one radiating element and at least one coaxial line are configured to interconnect indirectly in the sense that the at least one radiating element and a central inner conductor of the at least one coaxial line are configured to interconnect indirectly, and/or in the sense that the at least one radiating element and an outer conductor of the at least one coaxial line are configured to interconnect indirectly. In one such embodiment, the at least one radiating element and a central inner conductor of the at least one coaxial line are configured to interconnect indirectly, while the radiating element and an outer conductor of the at least one coaxial line are configured to interconnect galvanically.

In embodiments, the at least one radiating element comprises a coupling element for interconnecting with the at least one central inner conductor. The indirect connection between the radiating element and the coaxial line may consist of an indirect connection between the coupling device and the inner conductor of the coaxial line, an indirect connection between the radiating element body and the coaxial line outer conductor, or a combination of both.

The at least one radiating element may each comprise two or more radiating parts which may extend essentially in plane parallel with the antenna reflector. The radiating parts may have an electrical length of approximately one quarter of a wavelength at the operating frequency and be positioned approximately at a distance equivalent to one quarter of a wavelength at the operating frequency. The radiating parts may be fed in counter-phase. Such a feeding may be achieved by using a balanced-unbalanced transformer, also called a balun, which may also form a mechanical support for the two radiating parts. The balun may also be used as an impedance matching element. The balun may consist of a body part and the coupling element which is positioned in the centre of a cylindrical hole in the body part. The body part may be connected to outer conductor and to the antenna reflector.

The indirect interconnection may be achieved by means of at least one insulating layer. The insulating layer may be arranged on the coupling element and/or on portions of the at least one inner conductor. The insulating layer may be provided by means of a coating on the coupling element and/or on the at least one inner conductor, the coating comprising at least one polymer and/or oxide material. Alternatively, the insulating layer may be a separate component of a non-conductive material placed between the coupling element and the at least one inner conductor.

In embodiments, the at least one radiating element comprises a coupling element which comprises a free end portion, wherein the coupling element is configured to interconnect with a central inner conductor of the at least one coaxial line via the free end portion. The at least one inner conductor may comprise a receiving cavity or through hole configured to receive the free end portion. In these embodiments, the insulating layer may be provided on the free end portion and/or in said cavity or through hole. The free end portion may be conically shaped. Alternatively, the free end portion may be cylindrically shaped. The cavity or through hole may also be conically or cylindrically shaped, preferably having the same shape as the free end portion such that the free end portion fits tightly in the cavity or through hole. Such a cavity or through hole thus has the function to help secure the position of the free end portion and thus the coupling element in a plane parallel to a plane defined by the electrically conductive reflector. As described above, the free end portion may be conically shaped, e.g. formed as an inverted cone. An inverted cone may simplify the connection by making it easier to guide the connector element into the cavity or through hole of the inner conductor. The receiving cavity or through hole may extend partially or all the way through the at least one inner conductor.

In embodiments, the antenna arrangement comprises a snap on mechanism, where the snap on mechanism comprises a snap on portion integrally arranged on the coupling element, at least in proximity of the free end portion, and a complementary snap on portion arranged on or forming a portion of the inner conductor.

The coupling element may comprise a conductor line portion, where the free end portion is formed with a step at an end of the conductor line portion. The free end portion or the step may have a greater diameter than the conductor line portion. The step may form the snap on portion of the coupling element.

The snap on mechanism may comprise a snap on bracket comprising the complementary snap on portion. The snap on bracket may be configured to be snapped around the at least one of the inner conductors. The snap on bracket may be made of a plastic material.

Although it has been described to use the step as snap on portion, the snap on portion may be embodied in another way such as for example a protrusion, a circumferential protrusion, a notch or a groove being arranged on the coupling conductor element.

The snap on mechanism may improve handling when connecting the radiating elements to the inner conductors. In embodiments, the snap on mechanism is releasably attachable.

In an alternative embodiment, the snap on mechanism comprises a dielectric support element configured to hold and at least partially surround the at least one of the inner conductors, wherein the dielectric support element comprises the complementary snap on portion. The dielectric support element may be configured to hold the inner conductor in position inside the outer conductor, and may be made of a plastic material.

The complementary snap on portion may be realized in the form of snap on fingers or extensions, which are configured to engage the snap on portion when the free end portion is in an engaged position. The engaged position may be when the free end portion is positioned on or in the inner conductor in order to provide an indirect electrical connection there between.

In embodiments, the snap on portion of the coupling element comprises a snap on bracket configured to engage with the complementary snap on portion of said inner conductor. The coupling element may comprise a conductor line portion, wherein the free end portion is formed at an end of the conductor line portion. The snap on bracket is preferably formed at the free end portion of the coupling element as a pair of snap on fingers. The complementary snap on portion may be provided in the form of a portion of the envelope surface of said inner conductor. The portion may be formed as a recess in the envelope surface, for example as a portion of the envelope surface having a smaller diameter than the adjacent portions of the envelope surface.

The embodiments described above may be combined in any way.

In embodiments, the radiator body has an insulating layer on its surface which is close to the coaxial line outer conductor, alternatively the coaxial line has an insulating layer where the radiator body is located, or an insulating film is inserted between the radiator body and the coaxial line outer conductor in order to create an indirect connection between the radiator body and the coaxial line outer conductor.

According to an eight aspect of the invention, a method for manufacturing an antenna arrangement for mobile communication is provided. The method comprises providing an antenna feeding network comprising at least one substantially air filled coaxial line, each comprising a central inner conductor and an elongated outer conductor surrounding the central inner conductor, providing at least one radiating element, and interconnecting the radiating element and the at least one coaxial line indirectly.

In embodiments of the method according to the eighth aspect of the invention, the step of interconnecting comprises interconnecting the radiating element and the at least one central inner conductor of the at least one coaxial line indirectly, and/or interconnecting the radiating element and the outer conductor of the at least one coaxial line indirectly. In one such embodiment, the step of interconnecting comprises interconnecting the radiating element and the at least one central inner conductor of the at least one coaxial line indirectly, and interconnecting the radiating element and the outer conductor of the at least one coaxial line galvanically.

The description above of embodiments also applies to embodiments of the eighth aspect of the invention in an analogous manner.

BRIEF DESCRIPTION OF THE DRAWINGS

These and other aspects of the present invention will now be described in more detail with reference to the appended drawings, which show presently preferred embodiments of the invention, wherein.

DETAILED DESCRIPTION

Figure 1:
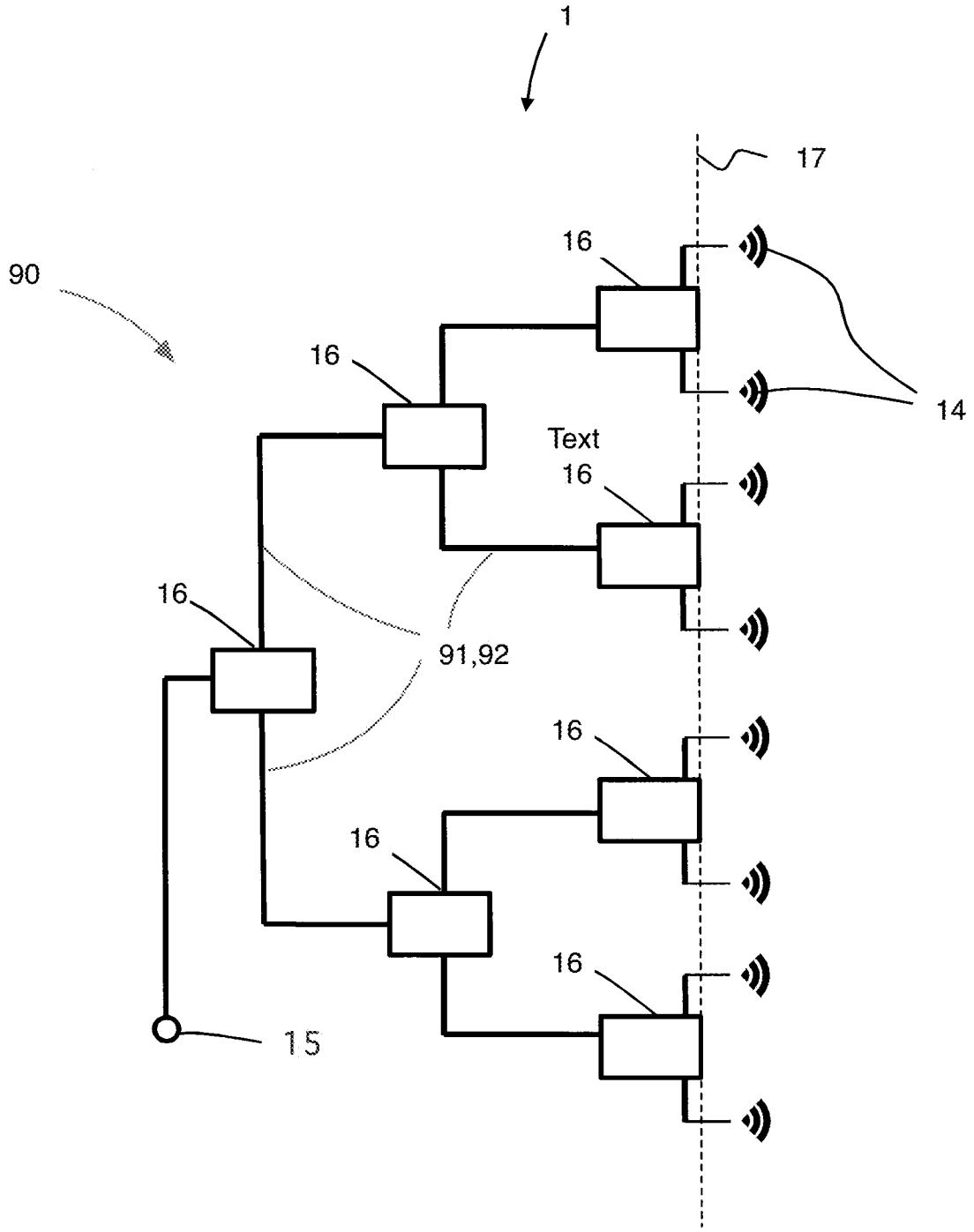
FIG. 1 shows a schematic view of an antenna feeding network for a multi radiator antenna.

FIG. 1 schematically illustrates an antenna arrangement 1 comprising an antenna feeding network 90, an electrically conductive reflector 17, which is shown schematically in FIG. 1, and a plurality of radiating elements 14. The radiating elements 14 may be dipoles. The antenna feeding network 90 connects a coaxial connector 15 to the plurality of radiating elements 14 via a plurality of lines 91, 92 which may be coaxial lines, which are schematically illustrated in FIG. 1. The signal to/from the connector 15 is split/combined using, in this example, three stages of splitters/combiners 16.

Figure 2:
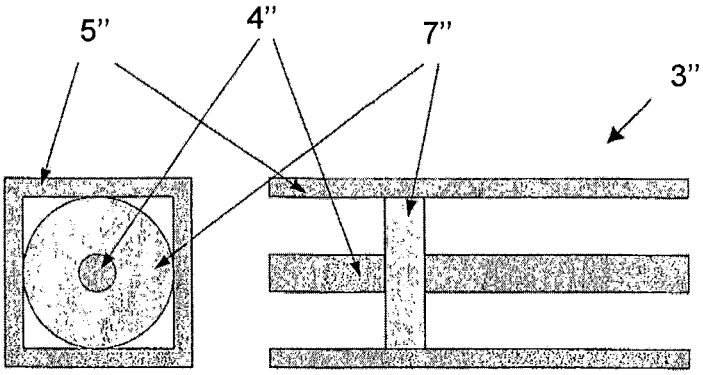
FIG. 2 shows a cross section view of a prior art coaxial line.

FIG. 2 shows a cross section view of a prior art coaxial line 3", where the outer conductor 5" is formed as a square cross section tube, and the inner conductor 4" is supported by dielectric support means 7".

Figure 3:
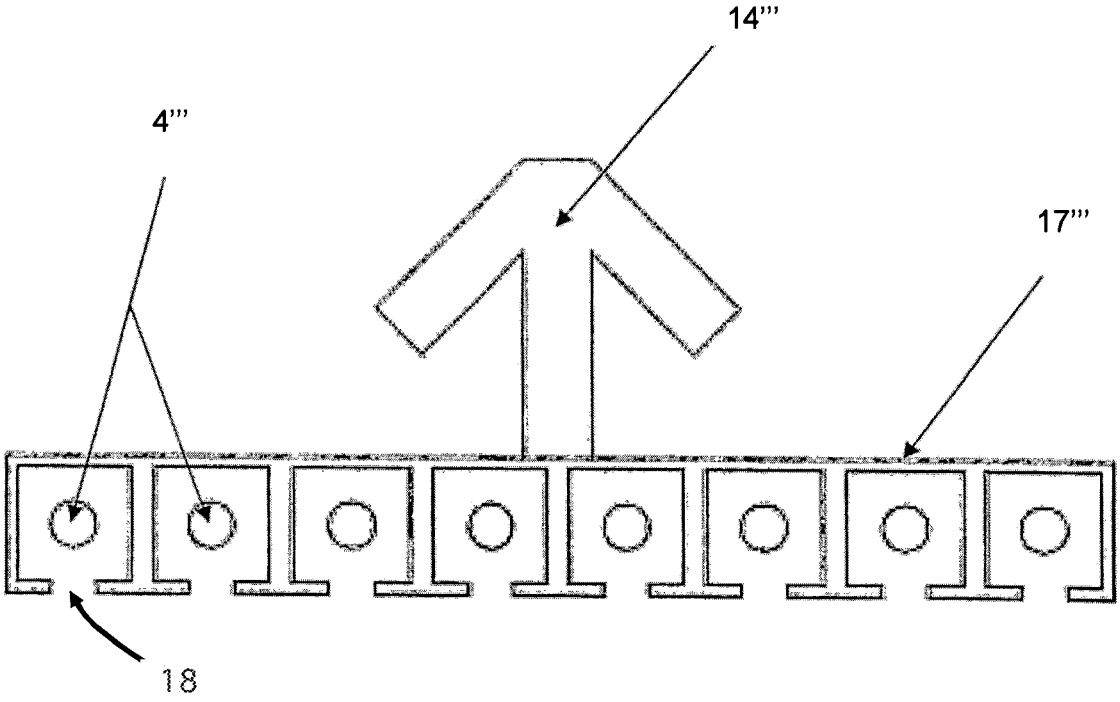
FIG. 3 shows a schematic cross section view of a prior art multi-radiator antenna, where the outer conductors of the coaxial lines combine to form a reflector for the radiators.

FIG. 3 shows a schematic cross section view of a prior art multi-radiator antenna, having an antenna feeding network comprising a plurality of coaxial lines, each having an outer conductor with a substantially square cross section and an inner conductor 4''' arranged in the outer conductor. The antenna feeding network is of the open type, i.e. each of the coaxial lines is provided with a longitudinally extending opening 18 along one side of the outer conductor, in this case along the bottom of the outer conductor. The antenna further comprises a reflector 17''' which is formed by upper outer surfaces of the outer conductors of the coaxial lines, and radiators/dipoles 14''' arranged in parallel (only one is seen in the figure) on the reflector. The antenna feeding network and the reflector form a self-supporting structure.

Figure 4:
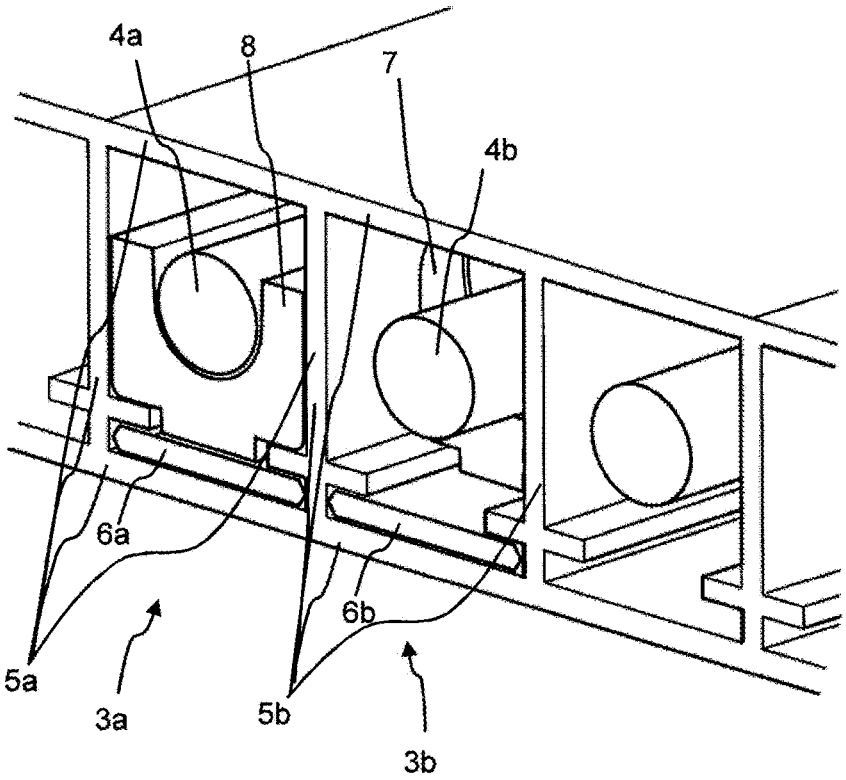
FIG. 4 shows a detail view of an antenna feeding network according to an embodiment of the first aspect of the invention.

FIG. 4 shows a detail view of an antenna feeding network according to an embodiment of the first aspect of the invention. The feeding network comprises a plurality of parallel coaxial lines. The figure shows two coaxial lines 3*a*, 3*b* which each comprise a central inner conductor 4*a*, 4*b*, an elongated outer conductor 5*a*, 5*b* forming a cavity or compartment around the central inner conductor, and an elongated rail element 6*a*, 6*b* slidably arranged inside the outer conductor. The outer conductors 5*a*, 5*b* have square cross sections and are formed integrally and in parallel to form a self-supporting structure. The wall which separates the coaxial lines 3*a*, 3*b* constitute vertical parts of the outer conductors 5*a*, 5*b* of both lines. The rail elements 6*a*, 6*b* are longitudinally movable relative the outer conductors. In the figure is illustrated a support element 7 which is arranged between the rail element 6*b* and the inner conductor 4*b*, and also between the inner and outer conductors. Furthermore, the coaxial line 3*a* is provided with a dielectric element 8 which is attached to the elongated rail element 6*a* and is configured to co-operate with the coaxial line 3*a*. The dielectric element 8 has a U-shaped cross section and is arranged around the inner conductor 4*a* such that it partially surrounds the inner conductor from below and fills most of the cavity between the conductors. Arranging the dielectric element 8 in the cavity between the inner and outer conductor forms a phase shifting device arranged to adjust the phase of signals in coaxial line 3*a*. Since the dielectric element 8 is attached to the rail element 6*a*, the phase may be adjusted by moving or sliding the rail element longitudinally until the desired position and phase shift is achieved.

Figure 5:
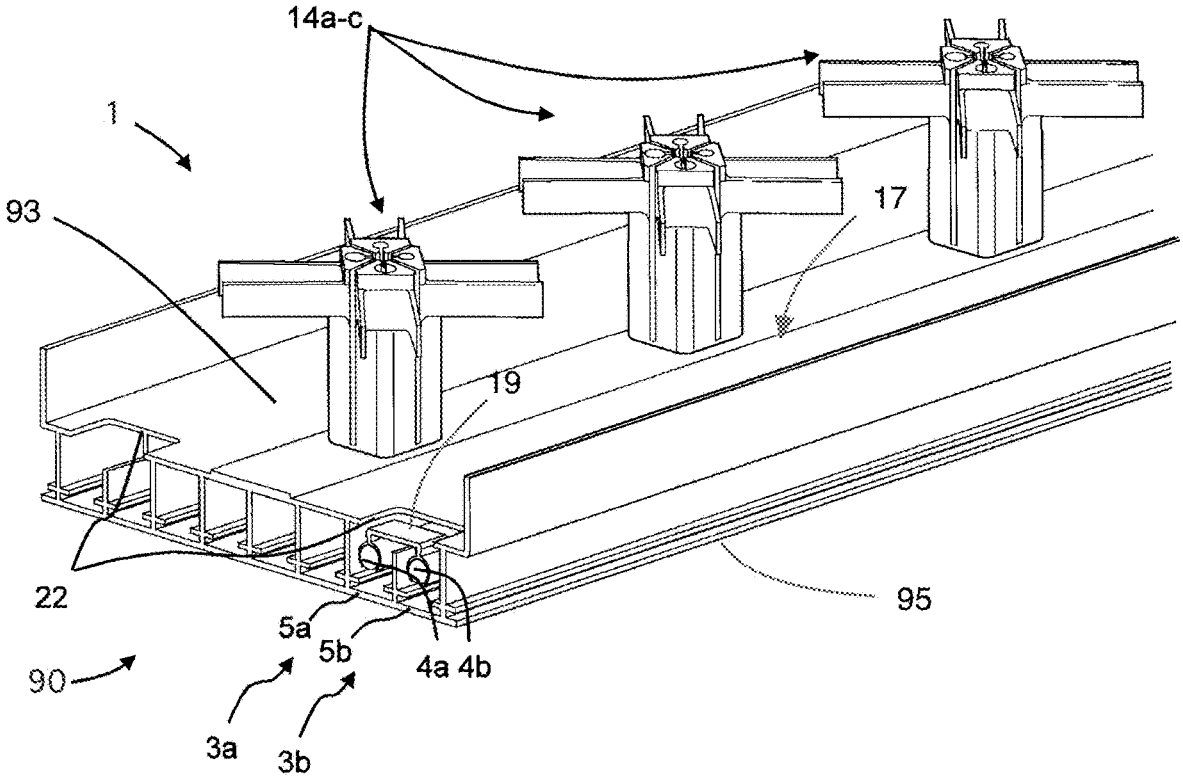
FIG. 5 shows a view of a multi radiator antenna according to an embodiment of the second aspect of the invention.

FIG. 5 shows a view of a multi radiator antenna according to an embodiment of the second aspect of the invention. The antenna 1 comprises an antenna feeding network 90, a reflector 17 and three radiating elements or dipoles 14*a-c* arranged on the reflector. The antenna feeding network is provided with coaxial lines 3*a*, 3*b* having central inner conductors 4*a*, 4*b* and outer conductors 5*a*, 5*b*. The description above with reference to FIG. 4 also applies to this feeding network, although no rail elements are shown in FIG. 5. In this figure, it is illustrated how the coaxial lines are integrally formed with the reflector in the sense that the reflector 17 is formed by the upper walls of the outer conductors. Each outer conductor is formed by the walls defining an elongated compartment, the walls being made in a conductive material such as aluminum. The inner conductors and the rail elements are thus arranged in elongated compartments. Although only two of the compartments are provided with inner conductors in FIG. 5, it is realized that one or a plurality of the shown compartments may also be provided with inner conductors to form coaxial lines. It is further realized that the number of inner conductors (two) and number of radiators (three) shown are only for illustrative purposes, and that further inner conductors may be used to provide a splitting/combing antenna feeding network of the type shown in FIG. 1. Outer conductors of the antenna feeding network 90 are provided with openings 22. The openings 22 have an elongated shape in the lateral direction and are solely provided to allow electrical interconnection between inner conductors. The openings are thus of quite short extension in the longitudinal direction. The outer conductors thus substantially surround the inner conductors, and the antenna feeding network may be described as a substantially closed type of antenna feeding network.

Figure 6:
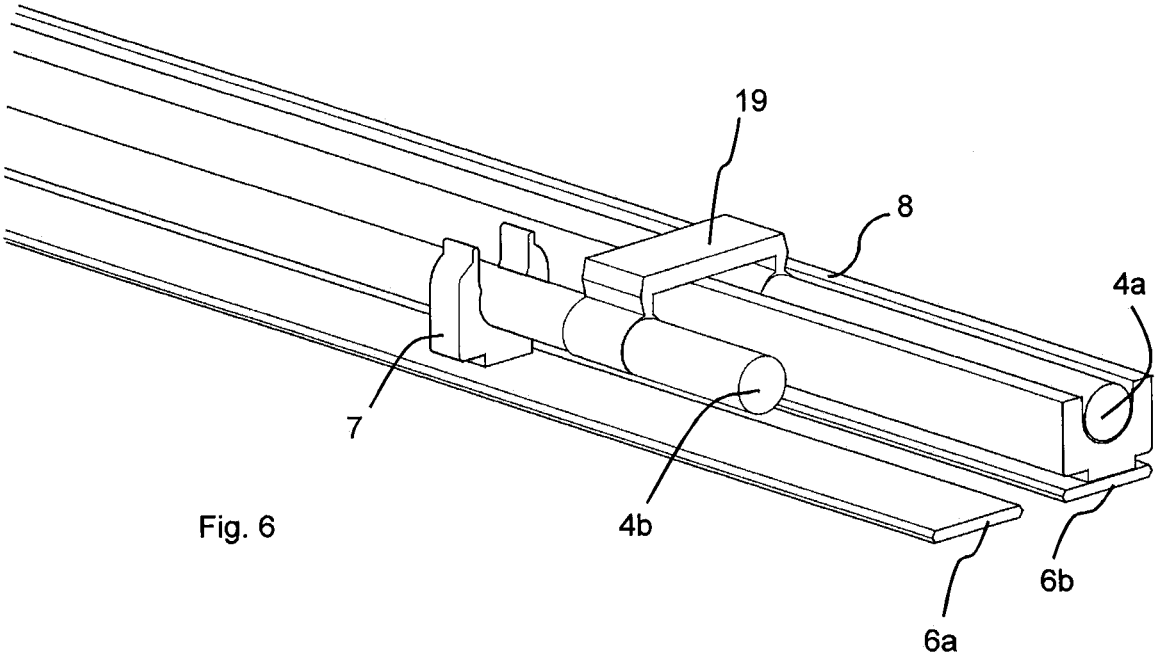
FIG. 6 shows parts of an antenna feeding network according to an embodiment of the first aspect of the invention.

FIG. 6 shows parts of the antenna feeding network shown in FIG. 4. The support element 7 may be held in the desired axial position by being arranged in a circumferential recess or groove (not shown) of the inner conductor 4*b*. The support element has a circular through hole provided with a side opening, and is made from a flexible plastic material such that the inner conductor may be inserted into the through hole via the side opening, such that the inner conductor and the support element is engaged with each other as shown in the figure. The elongated dielectric element 8 on the other hand is attached to the rail element 6*b* (and thereby axially fixated). Thus, the support element(s) is axially fixated relative to the inner conductor, while the dielectric element(s) is axially fixated to the rail element. Prior to inserting the inner conductors, rail elements, support element(s) and dielectric element(s) into the outer conductors, the inner conductors and the support element are placed on top of the rail element, for example as illustrated in FIG. 6. Thereafter, the inner conductors, rail elements, support element(s) and dielectric element(s) are pushed into corresponding outer conductors as a single unit. Since the support element 7 is axially fixated to the inner conductor 4*b*, their relative positions are maintained after having been inserted into the corresponding outer conductor. After the inner conductors, rail elements, support element(s) and dielectric element(s) have been inserted into the outer conductors, each inner conductor is advantageously attached or fixated to the corresponding outer conductor, for example by means of at least one holding element. After the inner conductors have been attached or fixated, the rail elements may be moved back and forth independently of the inner conductors. It is understood that only axial portions of the inner conductors and rails are shown, and that at least one support element corresponding to that of inner conductor 4*b* may also be attached to inner conductor 4*a*, and that at least one rail dielectric element corresponding to element 8 may also be attached to the rail element 6*a*.

The connector device 19 and the inner conductors 4*a*, 4*b* together form a splitter/combiner. When operating as a splitter, the inner conductor 4*b* is part of the incoming line, and the two ends of the inner conductor 4*a* are the two outputs of the splitter. The dielectric element 8 can be moved along the inner conductor 4*a*, which forms first and second coaxial output lines on opposite sides of the connector device 19 (together with an outer conductor which is not shown). The dielectric element thus has various positions along those coaxial output lines.

We first consider the case when the dielectric element 8 is placed in a central position, equally filling the first and second output coaxial lines. When a signal is entered at the input coaxial line 4*b*, it will be divided between the first output coaxial line and the second output coaxial line, and the signals coming from the two output coaxial lines will be equal in phase. If the dielectric element 8 is moved in such a way that the first output coaxial line will be more filled with dielectric material than the second output coaxial line, the phase shift from the input to the first output will increase. At the same time the second output coaxial line will be less filled with dielectric, and the phase shift from the input to the second output will decrease. Hence, the phase at the first output will lag the phase at the second output. If the dielectric part is moved in the opposite direction, the phase of the first output will lead the phase of the second output. The splitter/combiner may thus be described as a differential phase shifter.

Figure 7:
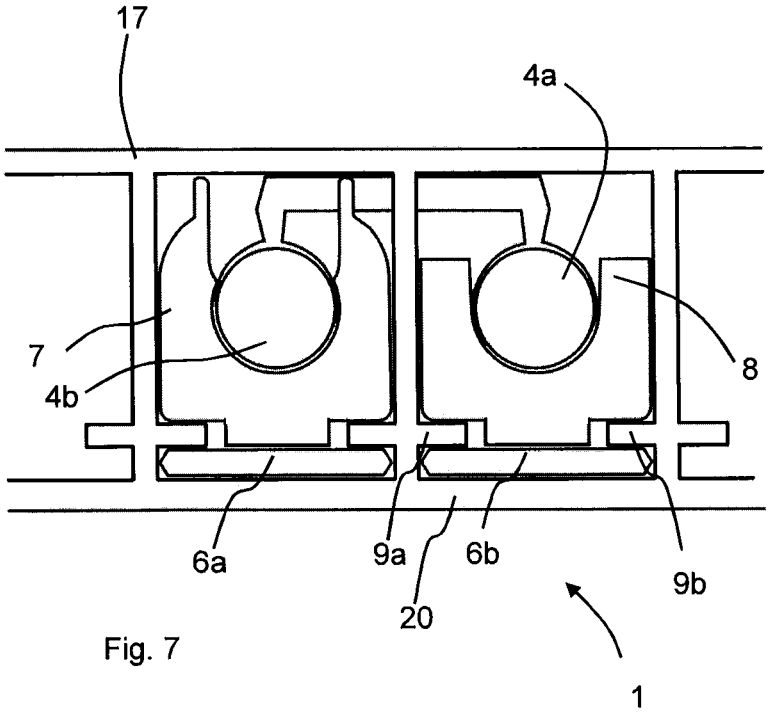
FIG. 7 shows a cross section view of an antenna feeding network according to an embodiment of the first aspect of the invention.

FIG. 7 shows a detailed cross section view of the antenna feeding network shown in FIG. 4. In FIG. 7, it is clearly illustrated how the outer conductor is provided with guiding means configured to guide the rail element inside the outer conductor. The guiding means comprises one longitudinally extending protrusion or ridge 9*a*, 9*b* on each inner side wall of the outer conductor arranged at a distance from the bottom surface of the outer conductor corresponding to the thickness of the rail element 6*b*. The ridges extend in parallel along the whole or essentially the whole length of the outer conductor (in the depth direction as shown in the figure), such that the rail element is guided from below by the bottom surface 20 and from above by the ridges 9*a*, 9*b*.

Figure 8:
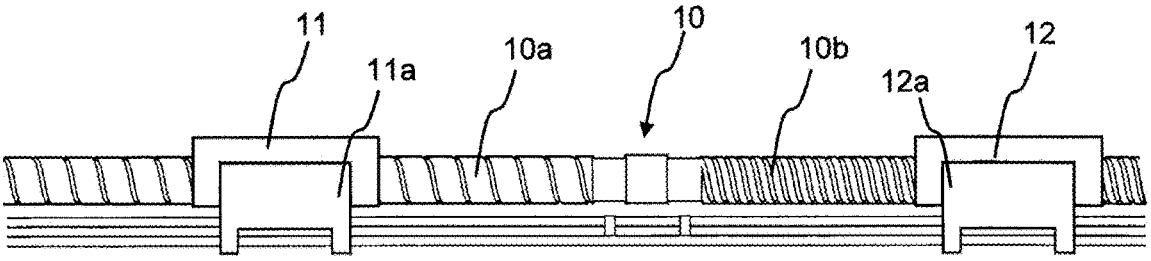
FIG. 8 shows means for moving two rail elements in an antenna feeding network according to an embodiment of the first aspect of the invention in a partial cross section view from the side.

FIG. 8 shows means for moving two rail elements in an antenna feeding network according to an embodiment of the first aspect of the invention. The means for moving the two rail elements of the coaxial lines is configured to move the rail elements simultaneously at different speeds. The means for moving comprises a longitudinally extending rod 10 and at least first and second connecting elements 11, 12, each connecting element being provided with an internally threaded portion 11*a*, 12*a*, the internally threaded portions being configured to co-operate with corresponding (externally) threaded segments or portions 10*a*, 10*b* of the rod 10, wherein the threaded segment or portion 10*a* of the rod has a greater pitch than the other threaded segment or portion 10*b*, such that the first connecting element 11 moves at a greater speed than the second connecting element 12 when the rod is rotated. The connecting elements 11, 12 are connectable to respective rail elements (not shown in the figure) through elongated slots in the outer conductors. The rod may be rotated manually or using electric motors controlled by a controlling device such as micro-controller.

When using electric motors, the rails, and hence the downtilt of the antenna, can be controlled remotely. The remote control can be achieved e.g. by connecting the motor and micro-controller to a cellular base station, or some other means for control. The means for moving two rail elements illustrated in FIG. 8 may be combined with two or more splitter/combiners of the differential phase shifting type illustrated in FIG. 6. Thus, the means for moving may be configured to move a rail element 6*b* and dielectric element 8 of a first splitter/combiner simultaneously and at a different speed than a rail element and dielectric of a second splitter/combiner. Such a combination including a plurality of differential phase shifters may be used in an antenna arrangement to provide a variable electrical tilt angle.

Figure 9:
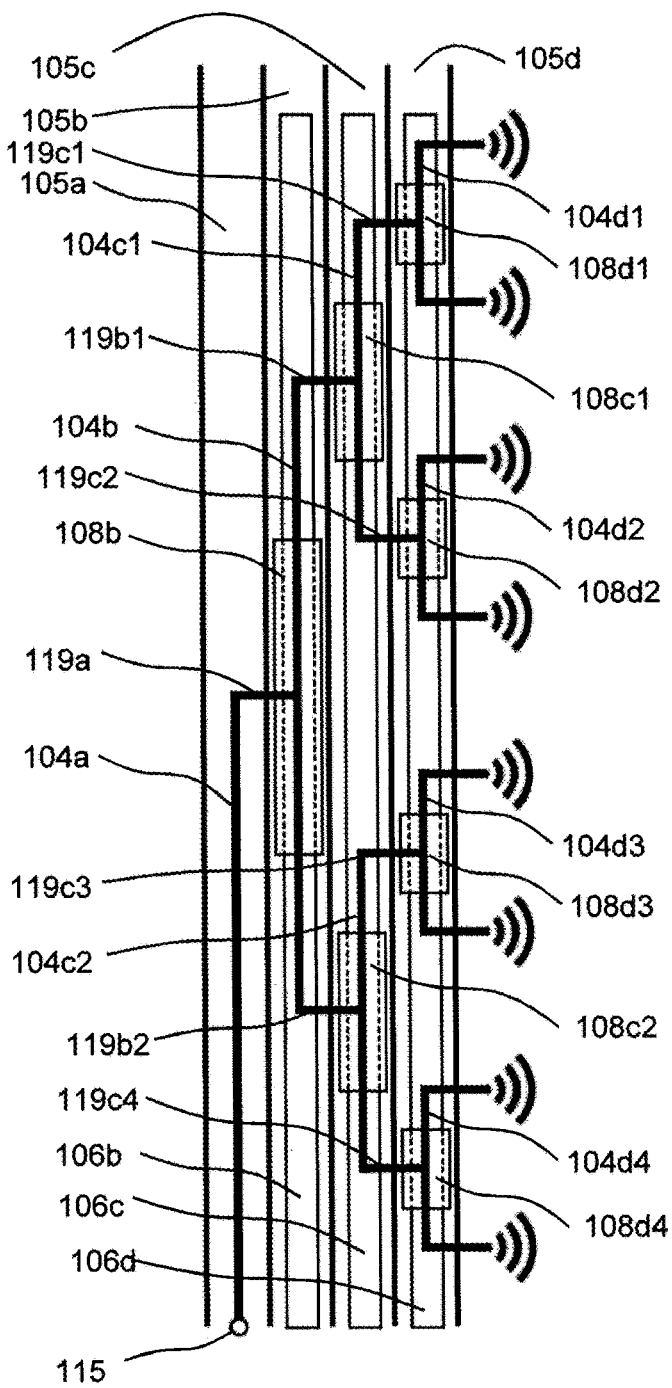
FIG. 9 shows a schematic view of an antenna feeding network according to an embodiment of the first aspect of the invention.

FIG. 9 shows a schematic cross section view of an antenna feeding network. The feeding network comprises eight coaxial lines. The figure shows four compartments 105*a*-105*d* formed in parallel in an integral self-supporting structure. The walls which separate the compartments constitute vertical parts of the outer conductors. In each of the first and second compartments 105*a*, 105*b*, a single inner conductor 104*a*, 104*b* is arranged, forming first and second coaxial lines together with the walls defining the compartment. In the compartment 105*c*, two inner conductors 104*c*1, 104*c*2 are arranged spaced apart from each other as seen in the longitudinal direction forming third and fourth coaxial lines using the walls defining compartment 105*c* as outer conductors. In the fourth compartment 105*d*, four inner conductors 104*d*1-104*d*4 are arranged spaced apart from each other as seen in the longitudinal direction forming fifth-eighth coaxial lines using the walls defining compartment 105*d* as outer conductors.

The inner conductor 104*a* forms part of an incoming line 115. The inner conductor 104*a* of the first coaxial line is interconnected to the inner conductor 104*b* of the second coaxial line by means of a connector device 119*a*. Opposite ends of the inner conductor 104*b* of the second coaxial line are interconnected to the inner conductors 104*c*1 and 104*c*2, respectively, by means of connector devices 119*b*1 and 119*b*2. Opposite ends of the inner conductor 104*c*1 of the third coaxial line are interconnected to the inner conductors 104*d*1 and 104*d*2, respectively, by means of connector devices 119*c*1 and 119*c*2. The inner conductor 104*c*2 is connected to the inner conductors 104*d*3 and 104*d*4 by means of connector device 119*c*3 and 119*c*4 in the same manner. The connector devices 119*a*, 119*b*1-*b*2, 119*c*1-*c*3 may be of the same type shown in FIG. 6 and described above. Each of the inner conductors 104*b*, 104*c* and 104*d* may be considered to be a part of separate coaxial output lines on opposite sides of the corresponding connector device together with the outer conductors formed by the walls defining the respective surrounding compartment.

The second, third and fourth compartments 105*b*-*d* are each provided with an elongated rail element 106*b*-*d* slidably arranged inside the corresponding compartment. The rail elements are longitudinally movable in the compartment. The rail element 106*b* in the second compartment is provided with a dielectric element 108*b* which is attached thereto such that the first and second coaxial lines form a splitter/combiner with differential phase shift as described above with reference to FIG. 6. The rail element 106*c* in the third compartment is provided with two dielectric elements 108*c*1, 108*c*2 which are attached thereto in a longitudinally spaced apart manner. The dielectric elements 108*c*1, 108*c*2 are configured to co-operate with a respective coaxial line formed with inner conductor 104*c*1, 104*c*2, such that the second coaxial line together with the third and fourth coaxial lines form two splitters/combiners with differential phase shift. In the same manner, the rail element 106*d* in the fourth compartment is provided with four dielectric elements 108*d*1-*d*4 which are attached thereto in a longitudinally spaced apart manner. The dielectric elements 108*d*1-*d*4 are configured to co-operate with a coaxial line formed with respective inner conductor 104*d*1-*d*4, such that the third and fourth coaxial lines together with the fifth-eighth coaxial lines form four splitters/combiners with differential phase shift. In other embodiments, the dielectric elements in the fourth compartment are omitted. The dielectric elements may be of the same type shown in FIG. 6 and described above.

As shown schematically in the figure, the ends of the fourth-eighth coaxial lines are each connectable to a corresponding radiator/dipole, thus forming a multi radiator antenna. The upper side of the outer conductors (not visible in the shown cross section view) may form a reflector on which the radiators are arranged in the same manner as shown in FIG. 5 and described above.

The embodiments shown in FIGS. 8 and 9 are advantageously combined to provide an antenna with electrically adjustable tilt. In such an embodiment, the means for moving are preferably configured to move the rail 106*c* (and the dielectric elements 108*c*1-*c*2) twice as fast/long as the rail 106*d* (and the dielectric elements 108*d*1-*d*4), and to move the rail 106*b* (and the dielectric element 108*b*) twice as fast/long as the rail 106*c*, i.e. four times as fast/long as the rail 106*d*.

The text above describes one possible, but not limiting, embodiment of the invention. Other embodiments are possible, e.g. with other numbers of radiators such as 2, 4, 6, 10, 12, 14, 16, 18 etc. Embodiments with odd numbers of radiators are also possible. In such other implementations, the movement of the different rails will not be exactly twice or four times compared to that of the slowest moving rail.

Returning to FIG. 5, which illustrates a multi-radiator antenna 1 in a perspective view, the antenna 1 comprises the electrically conductive reflector 17 and radiating elements 14*a*-*c*.

The electrically conductive reflector 17 comprises a front side 93, where the radiating elements 14*a*-*c* are mounted and a back side 95.

FIG. 5 shows a first coaxial line 3*a* which comprises a first central inner conductor 4*a*, an elongated outer conductor 5*a* forming a cavity or compartment around the central inner conductor, and a corresponding second coaxial line 3*b* having a second inner conductor 4*b* and an elongated outer conductor 5*b*. The outer conductors 5*a*, 5*b* have square cross sections and are formed integrally and in parallel to form a self-supporting structure. The wall which separates the coaxial lines 3*a*, 3*b* constitute vertical parts of the outer conductors 5*a*, 5*b* of both lines. The first and second outer conductors 5*a*, 5*b* are formed integrally with the reflector 17 in the sense that the upper and lower walls of the outer conductors are formed by the front side 93 and the back side 95 of the reflector, respectively.

Although the first and second inner conductors 4*a*, 4*b* are illustrated as neighbouring inner conductors they may actually be further apart thus having one or more coaxial lines, or empty cavities or compartments, in between.

In FIG. 5 not all longitudinal channels or outer conductors are illustrated with inner conductors. It is however clear that they may comprise such inner conductors.

Figure 15:
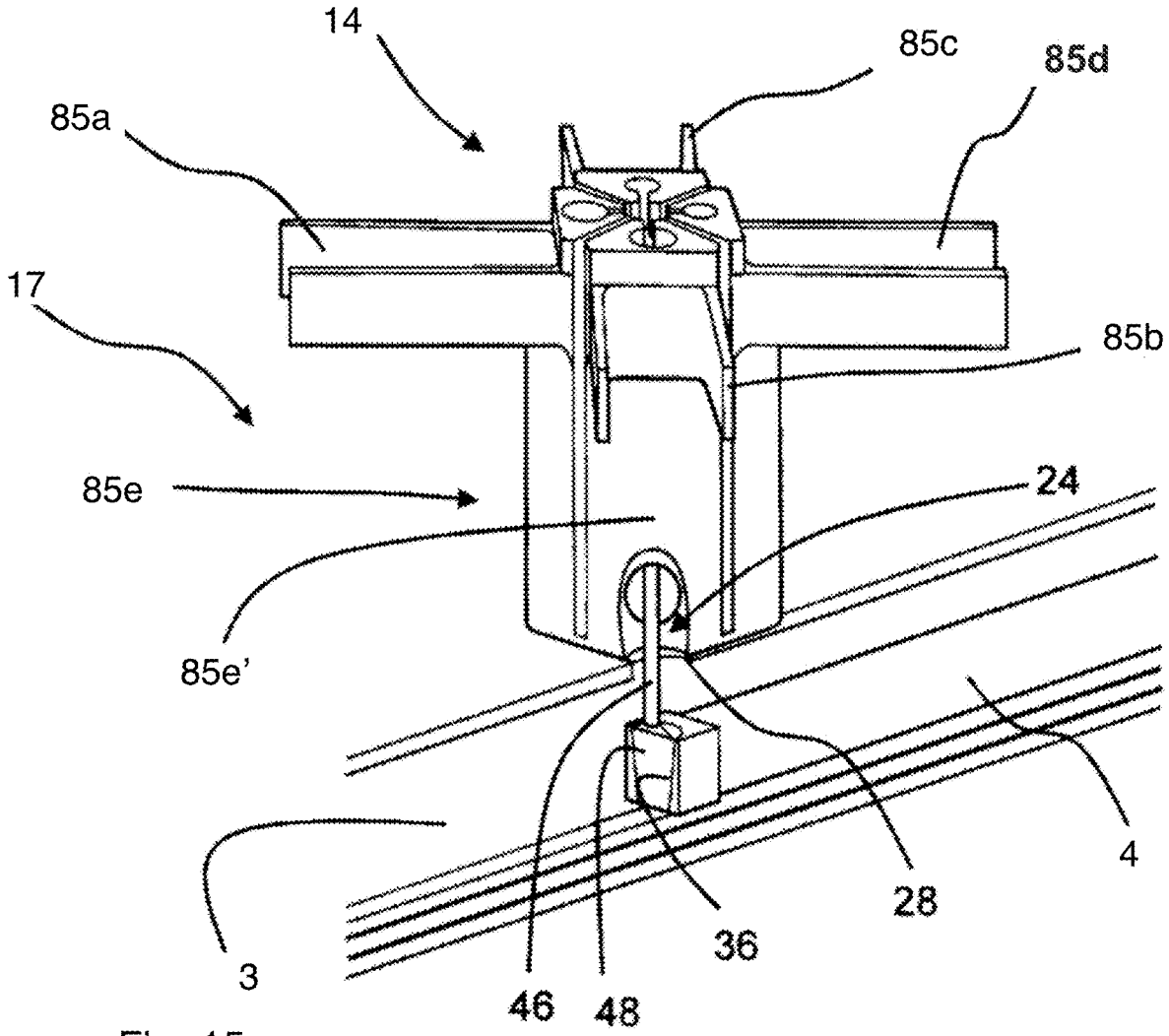
FIG. 15 schematically illustrates an embodiment of an antenna arrangement according to the seventh aspect of the invention, showing a perspective view onto a cross section cut through the middle of one of the radiating elements along a coaxial line.

Each of the radiating elements 14 is configured to be electrically connected to at least one of the inner conductors 4 via a coupling element 24 (c.f. FIG. 15).

The front side 93 of the reflector comprises at least one opening 22 for the installation of the connector device 19. The opening 22 extends over the two neighbouring coaxial lines 3*a*, 3*b* so that the connector device 19 can engage the first and second inner conductors 4*a*, 4*b*.

Although the invention is illustrated with two neighbouring inner conductors 4*a*, 4*b* it falls within the scope to have an opening (not shown) that extends across more than two coaxial lines 3*a*, 3*b* and to provide a connector device 19 than can bridge two or even more inner conductors. Such a connector device (not shown) may thus be designed so that it extends over a plurality of coaxial lines between two inner conductors or over empty cavities or compartments. Such a connector device (not shown) may also be used to connect three or more inner conductors.

Figure 10:
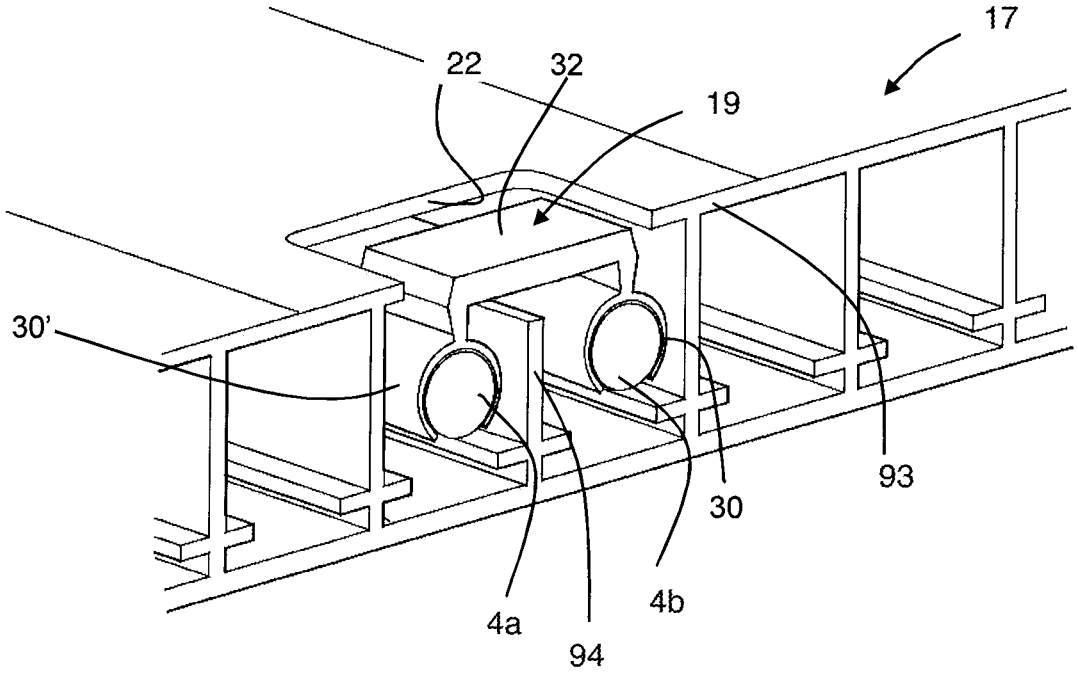
FIG. 10 schematically illustrates a perspective view of an embodiment of an antenna feeding network according to the fourth aspect of the invention.

In FIG. 10, an enlarged view of the opening 22 and the connector device 19 arranged therein is illustrated. The connector device 19 is clipped or snapped onto the first inner conductor 4*a* and the second inner conductor 4*b*. The connection between the first inner conductor 4*a* and the second inner conductor 4*b* is electrically indirect, which means that it is either capacitive, inductive or a combination thereof. This is achieved by providing a thin insulating layer of a polymer material or some other insulating material (e.g. a non-conducting oxide) on the connector device 19. The insulating layer may have a thickness of 1 μm to 20 μm, such as from 5 μm to 15 μm, such as from 8 μm to 12 μm, or may have a thickness of 1 μm to 5 μm. The insulating layer may cover the entire outer surface of the connector device 19, or at least the portions 30, 30' of the connector device 19 that engage the first and second inner conductors 4*a*, 4*b*.

The connector device 19 comprises a bridge portion 32 and two pairs of snap on fingers 30, 30'. One of the two pairs of snap on fingers 30' is arranged close to one end of the bridge portion 32 and the other of the two pairs of snap on fingers 30 is arranged close to the other end of the bridge portion 32. The two pairs of snap on fingers 30, 30' may be connected to the bridge portion 32 via connecting portions configured such that the bridge portion 32 is distanced from the first and second inner conductors 4*a*, 4*b*. In other embodiments, the snap on fingers 30, 30' are connected directly to the bridge portion 32. The connecting portions, as well as the other portions of the connector device, are shaped to optimize the impedance matching of the splitter/combiner formed by the connector device and the coaxial lines. The shape, or preferably the diameter of the connecting inner conductors may also contribute to the matching of the splitter/combiner.

As can be seen from FIG. 10, the vertical separating wall portion 94 is cut down to about two-thirds to three-quarters of its original height in the area of the opening 22 so that the connector device 19 does not protrude over the front side 93 of the electrically conductive reflector 17. In other embodiments, the wall portion 94 is cut down all the way to the floor of the outer conductors. The remaining height of the wall portion is adapted together with the other components, such as the connector device to optimize the impedance match.

It may be possible (not shown in the figures) to provide only one pair of snap on fingers, for example the pair of snap on fingers 30' engaging the first inner conductor 4*a* providing an indirect connection, and to let the other end of the bridge portion 32 contact the second inner conductor 4*b* directly without insulating layer or coating. This direct connection can be provided by connecting the bridge portion 32 to inner conductor 4*b* by means of a screw connection, or by means of soldering, or by making the bridge portion an integral part of inner conductor 4*b*, or by some other means providing a direct connection.

Figure 11:
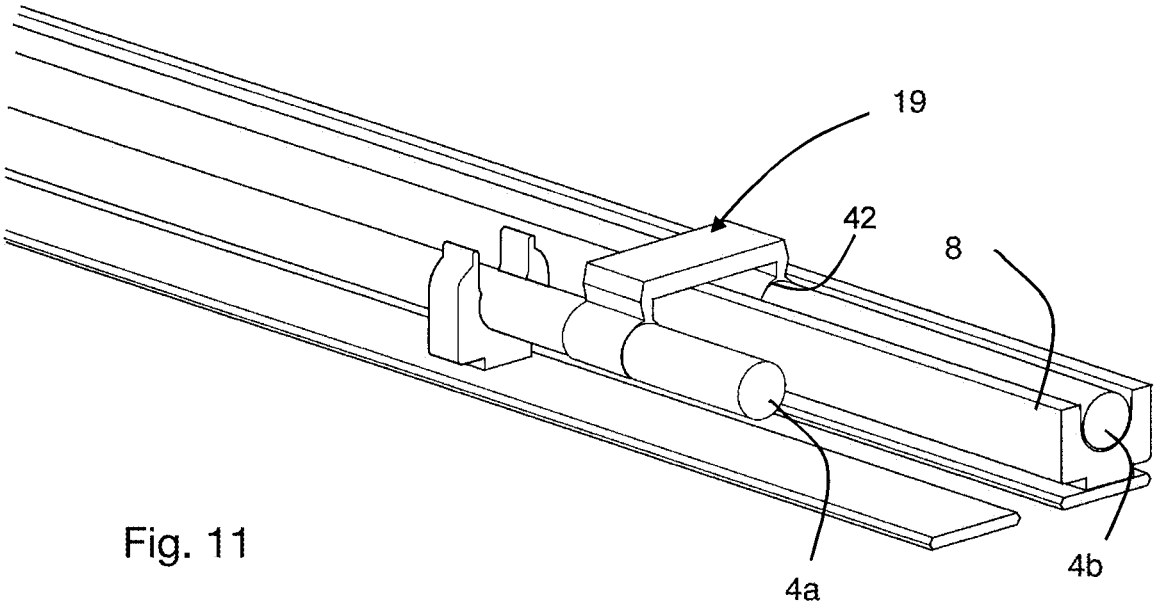
FIG. 11 schematically illustrates another perspective view of parts of an embodiment of an antenna feeding network according to the fourth aspect of the invention.

FIG. 11 shows another view of parts of an embodiment of the antenna feeding network. The connector device 19 engages the first and second inner conductors 4*a*, 4*b*. The connector device 19 and the inner conductors 4*a*, 4*b* together form a splitter/combiner. When operating as a splitter, the inner conductor 4*a* is part of the incoming line, and the two ends of the inner conductor 4*b* are the two outputs of the splitter. The U-shaped dielectric element 8 can be moved along the inner conductor 4*b*, which, together with an outer conductor (not shown), forms first and second coaxial output lines on opposite sides of the connector device 19. The dielectric element thus has various positions along those coaxial output lines.

We first consider the case when the dielectric element 8 is placed in a central position, equally filling the first and second output coaxial lines. When a signal is entered at the input coaxial line 4*a*, it will be divided between the first output coaxial line and the second output coaxial line, and the signals coming from the two output coaxial lines will be equal in phase. If the dielectric element 8 is moved in such a way that the first output coaxial line will be more filled with dielectric material than the second output coaxial line, the phase shift from the input to the first output will increase. At the same time the second output coaxial line will be less filled with dielectric, and the phase shift from the input to the second output will decrease. Hence, the phase at the first output will lag the phase at the second output. If the dielectric element is moved in the opposite direction, the phase of the first output will lead the phase of the second output. The splitter/combiner may thus be described as a differential phase shifter.

FIG. 11 illustrates how the connector device 19 engages the first and second inner conductors 4*a*, 4*b* in circumferential recessed areas or grooves 42 of the first and second inner conductors 4*a*, 4*b*. These grooves may be used to position the connector device 19 correctly along the longitudinal direction of the inner conductors 4*a*, 4*b*.

Figure 12:
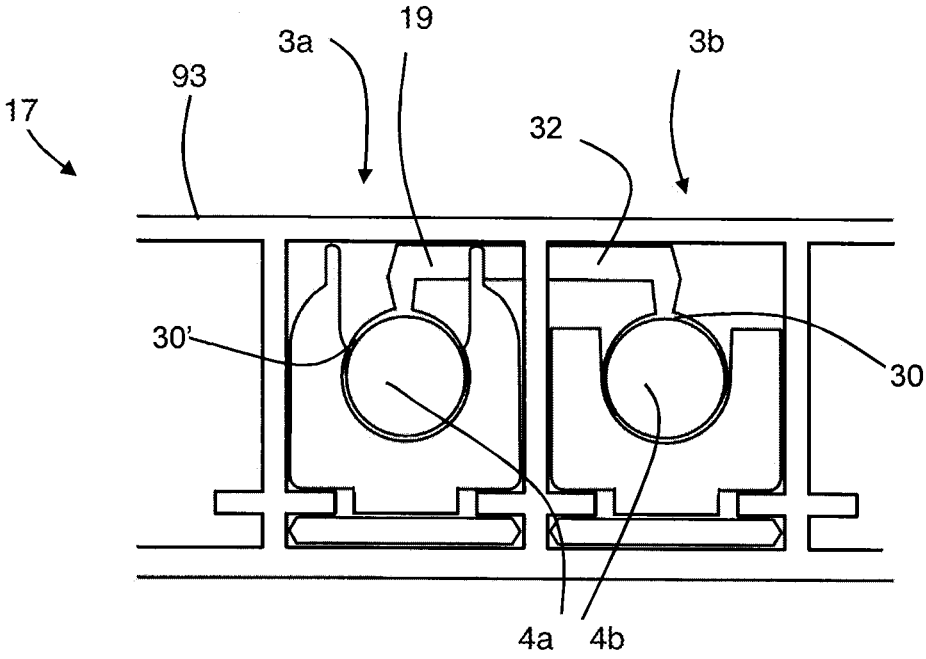
FIG. 12 schematically illustrates a front view into two neighbouring coaxial lines of an embodiment of an antenna feeding network according to the fourth aspect of the invention.

FIG. 12 illustrates a view into the first and second coaxial lines 3*a*, 3*b* where the connector device 19, bridging the first inner conductor 4*a* and the second inner conductor 4*b* is visible. The snap on fingers 30, 30' are not so well visible since the snap on fingers 30, 30' engage the first and second inner conductors 4*a*, 4*b* in areas with a smaller diameter than the rest of the first and second inner conductors 4*a*, 4*b*. FIG. 12 further illustrates that the bridge portion 32 is not extending beyond the front side 93 of the electrically conductive reflector.

The embodiment of the connector device 19 has been described having a thin insulating layer on the connector device 19. It may however be possible to provide the first and second inner conductors 4*a*, 4*b* respectively with a very thin insulating layer of a polymer material and provide the connector device without any insulating layer. The insulating layer may cover the entire outer surface of the first and second inner conductors 4*a*, 4*b*, or at least the portions where snap on fingers 30, 30' of the connector device 19 engage the first and second inner conductors 4*a*, 4*b*. In other embodiments, an isolating material in the form of a thin foil is placed between the snap-on fingers 30, 30' and the inner conductor 4.

Further, the connector device 19 has been described illustrating a first and a second inner conductor 4*a*, 4*b* in the antenna arrangement 1. The antenna arrangement 1 may however comprise more than one connector device 19 and a plurality of inner conductors 4*a*, 4*b*.

Figure 13:
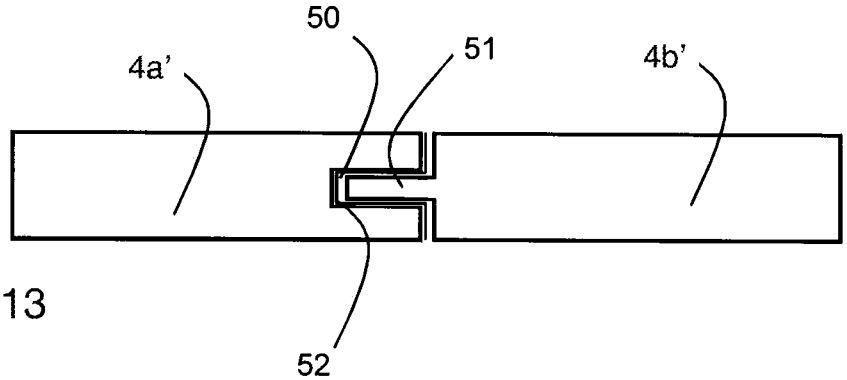
FIG. 13 schematically illustrates parts of another embodiment of an antenna feeding network according to the fourth aspect of the invention.

FIG. 13 schematically illustrates parts of another embodiment of an antenna feeding network according to the fourth aspect of the invention. In FIG. 13, a cross section view is shown of a first inner conductor 4*a*' and a second inner conductor 4*b*'. The first inner conductor 4*a*' comprises a cavity 50 extending axially into one of its ends. The second inner conductor 4*b*' comprises a rod-shaped protrusion 51 extending axially from one of its ends. The protrusion 51 is adapted to extend into the cavity 50 of the first inner conductor. An insulating layer 52 is provided in and around the cavity to provide an indirect electrical connection between the conductors. In other embodiments, the insulating layer may be provided on the protrusion 51, or as a separate insulating film between the conductors. The insulating layer may be provided as a polymer material or some other insulating material (e.g. a non-conducting oxide) on either or both inner conductors 4*a*' or 4*b*', completely or partially covering inner conductors 4*a*' or 4*b*', or it may be provided as a thin insulating foil inserted between inner conductors 4*a*' and 4*b*'.

Figure 14:
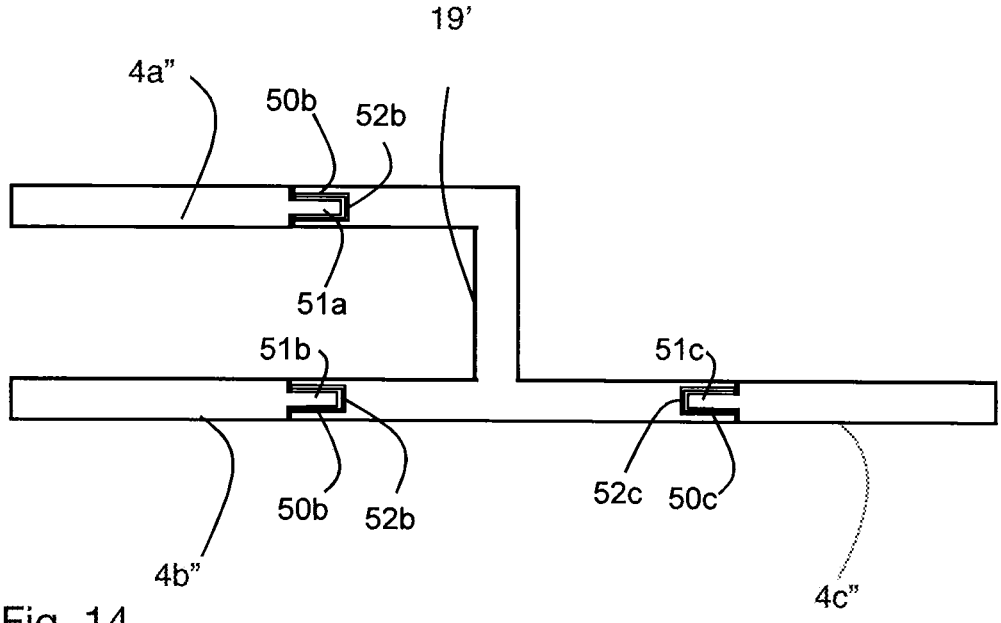
FIG. 14 schematically illustrates parts of yet another embodiment of an antenna feeding network according to the fourth aspect of the invention.

FIG. 14 schematically illustrates parts of yet another embodiment of an antenna feeding network according to the fourth aspect of the invention. In FIG. 14, a cross section view is shown of three inner conductors 4*a*", 4*b*" and 4*c*" and a three legged h-shaped connector device 19'. Each leg of the connector device 19' is provided with a cavity 50*a-c* extending axially into their respective ends. The inner conductors 4*a*"-*c*" each comprises a rod-shaped protrusion 51*a-c* extending axially from one of its ends. The protrusions 51*a-c* extend into corresponding cavities 50*a-c* of the connector device. Insulating layers 52*a-c* are provided in and around the cavities to provide an indirect electrical connection between the conductors. In other embodiments, the insulating layers may be provided on the protrusions, or as separate insulating films between the conductors and the connector device. The h-shaped connector device 19' may be mounted in a similar manner as the connector device 19, i.e. by cutting down a separating wall between two adjacent outer conductors. In other embodiments, the connector device 19' is provided with protrusions, and the inner conductors 4"-*c*" are provided with cavities.

FIG. 15 illustrates a perspective view onto a cross section cut through the middle of one of the radiating elements 14 in longitudinal direction of antenna arrangement. FIG. 15 also illustrates how the radiating element 14 is connected to one of the inner conductors 4. The radiating element 14 comprises a coupling element 24 having a conductor line portion 46 and a free end portion 48 at an end of the conductor line portion 46. The coupling conductor element 24 extends through the at least one opening 28 in the electrically conductive reflector 17 into a cavity or through hole 36 formed in the inner conductor 4.

The cavity or through hole 36 and the free end portion 48 of the coupling conductor element 24 are both conically shaped having corresponding diameter and rise to achieve a tight fit. The cavity or through hole 36 extends through the entire inner conductor 4 but may in other embodiments only extend partially into the inner conductor 4.

The coupling between the coupling element 24 and the inner conductor 4 is either capacitive, inductive or a combination therefore. This is achieved by providing a thin insulating layer on at least the free end portion 48 of the coupling element. In other embodiments, the cavity or through hole 36 comprises a thin insulating layer, while the free end portion does not. The insulating layer may have thickness of less than 50 μm, such as from 1 μm to 20 μm, such as from 5 μm to 15 μm, such as from 8 μm to 12 μm. In other embodiments, both the free end portion 48 and the cavity or through hole 36 comprise a thin insulating layer. The thin insulating layer could be provided by applying a thin layer of a polymer material, or by having a thin oxide layer, or by some other provisions applying an isolating layer.

The radiating elements 14 each comprise four identical radiating parts 85*a-d* forming a dipole. The radiating parts extend essentially in a plane parallel with the antenna reflector. The radiating parts are fed using a balanced-unbalanced transformer 85*e*, also called a balun, which also forms a mechanical support for the radiating parts. As is further illustrated in FIG. 15, the balun comprises a body part 85*e*' and the coupling element 24 which is positioned in the centre of a cylindrical hole in the body part. The body part 85*e*' is connected to the outer conductor and to the antenna reflector.

Figure 16:
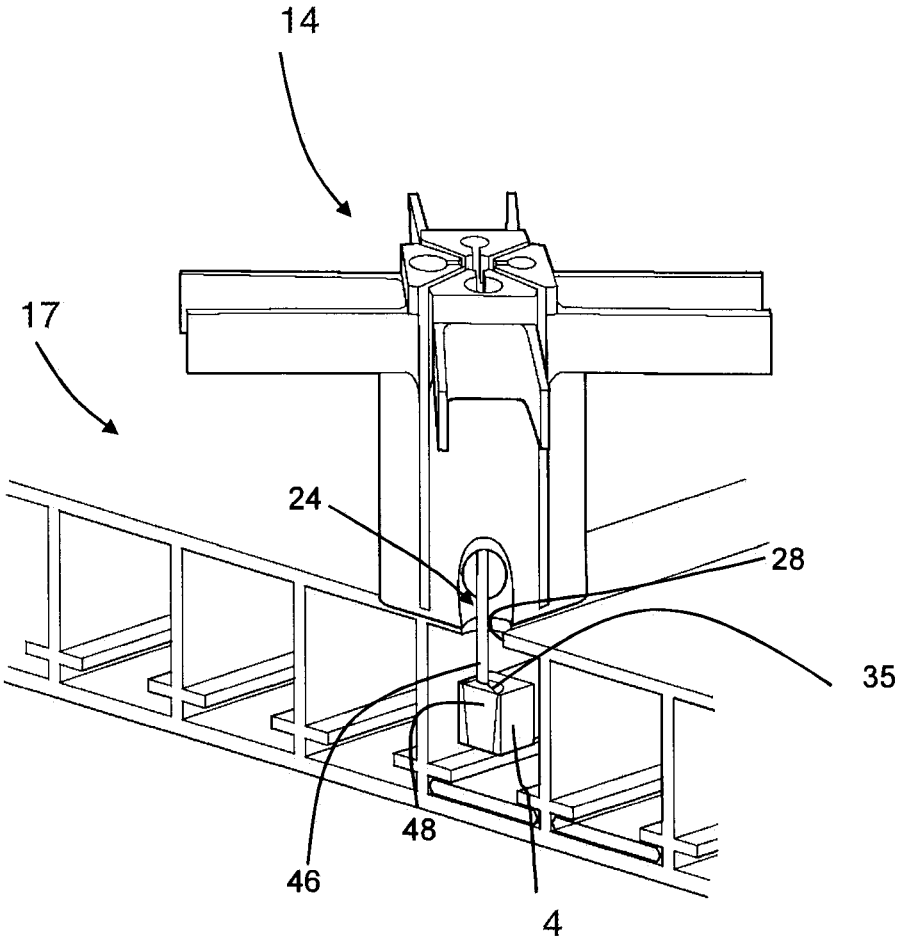
FIG. 16 schematically illustrates an embodiment of an antenna arrangement according to the seventh aspect of the invention, showing another perspective cross sectional view of the connection between the radiating element and the inner conductor, the cross section being cut perpendicular to the coaxial line.

FIG. 16 illustrates another perspective cross sectional view of the connection between the radiating element 14 and the inner conductor 4. The cross section is cut through the connection. The coupling element 24 and its enlarged free end portion 48 are shown. The free end portion 48 is conically inverted shaped and comprises a step 35 between the free end portion 48 and the conductor line portion 46. The free end portion 48 has a greater diameter than the conductor line portion 46.

Although the free end portion 48 has a conically inverted shaped it is conceivable that it has another shape such as cylindrical, cubical, etc. The shape of the cavity or through hole 36 may be adapted accordingly.

Figure 17:
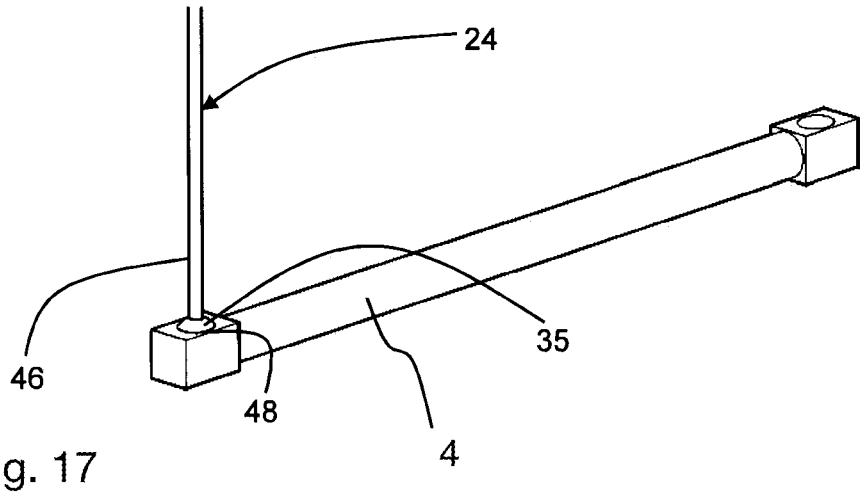
FIG. 17 schematically illustrates a view of a coupling element and an inner conductor of an embodiment of an antenna arrangement according to the seventh aspect of the invention.

FIG. 17 schematically illustrates the inner conductor 4 and the coupling conductor element 24 engaged in the cavity or through hole 36. As can be seen, the inner conductor 4 has a slightly greater diameter where the cavity or through hole 36 is shaped. This may be done for example for improved stability and/or a higher capacity of the indirect electric connection. The step 35 formed between the conductor line 46 and the enlarged free end portion 48 is also shown.

Figure 18:
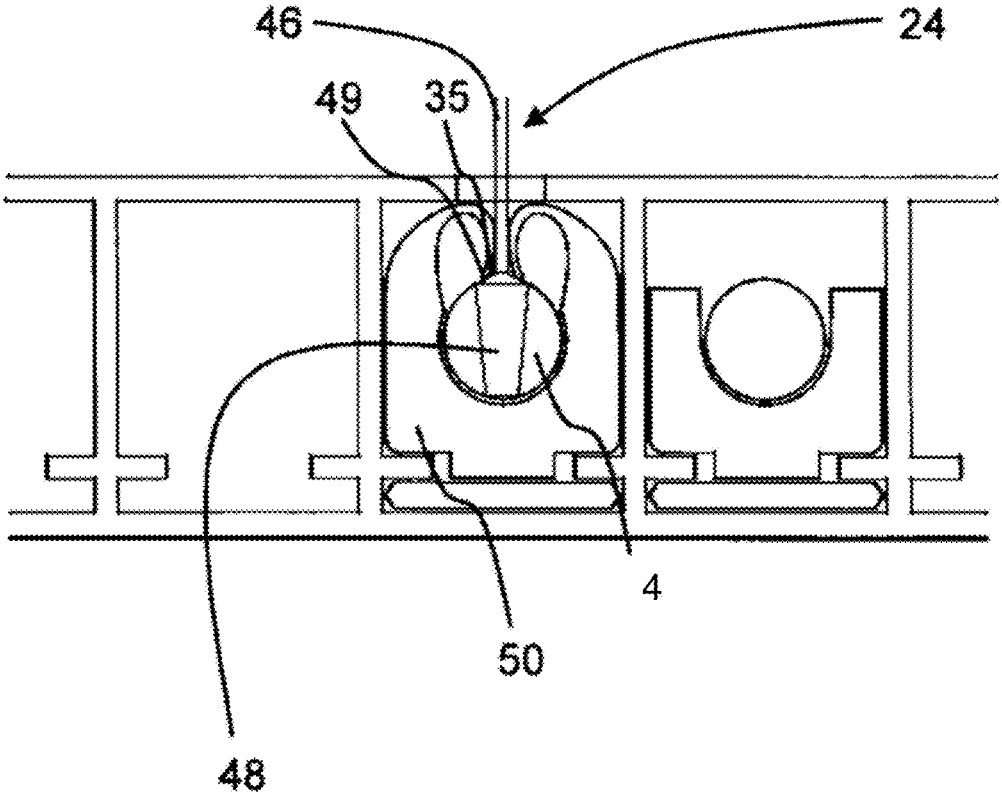
FIG. 18 schematically illustrates a cross section view of parts of an embodiment of an antenna arrangement according to the seventh aspect of the invention, which is provided with a snap-on mechanism.

FIG. 18 schematically illustrates a cross section view of parts of an antenna arrangement which comprise a snap on mechanism. The snap on mechanism has a snap on portion in the form of the step 35, which is integrally arranged on the coupling element 24 (only partially shown in the figure), above the free end portion 48, and a complementary snap on portion 49 arranged on the inner conductor 4. The complementary snap on portion 49 is formed as an edge of a dielectric support element 50 that is used to engage with and hold the inner conductor 4 in position within the outer conductor. The support element 50 is made from a plastic material which is slightly flexible which causes the opening in the spacer to widen slightly when the coupling element is pushed into the cavity or through hole of the inner conductor. After the coupling element has been pushed down, the edge/snap on portion 49 prevents it from accidentally leaving the cavity or through hole. In other embodiments, the complementary snap on portion is formed on a separate component which is not a dielectric support element.

Figure 19:
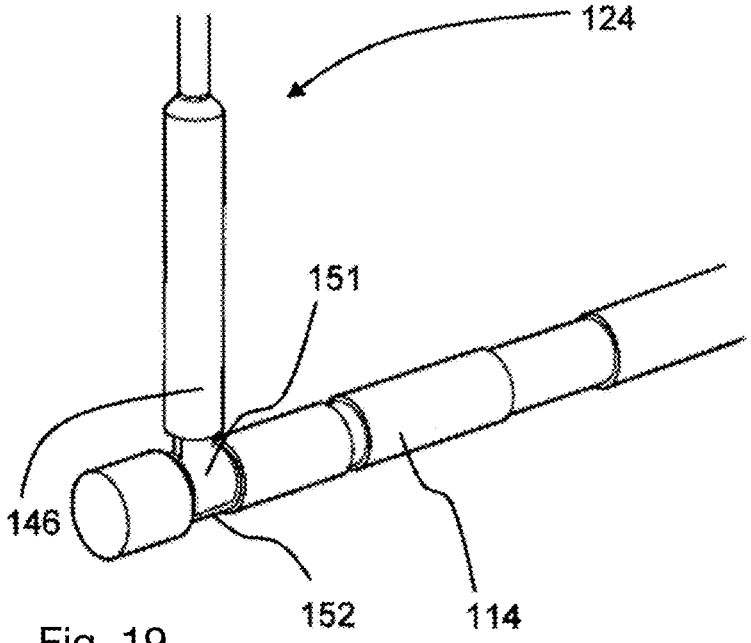
FIG. 19 schematically illustrates a view of a coupling element and an inner conductor of an alternative embodiment of an antenna arrangement according to the seventh aspect of the invention.

FIG. 19 schematically illustrates parts of an alternative embodiment of an antenna arrangement according to the seventh aspect of the invention. The figure shows an inner conductor 114 and a coupling conductor element 124 engaged with the inner conductor. The coupling element 124 is provided with a conductor line portion 146, wherein the free end portion is formed at an end of the conductor line portion, wherein a snap on portion is provided at the free end portion of the coupling element as a pair of snap on fingers 151 (only one is visible in the figure). The complementary snap on portion is provided in the form of a recessed portion 152 of the envelope surface of said inner conductor. The recessed portion has a smaller diameter than the adjacent portions of the envelope surface and has a length (in the longitudinal direction) which corresponds to that of the snap on fingers 151. The snap on fingers 151 may be described as a pair of protrusions configured to engage around the inner conductor, which fingers or protrusions may be configured to be flexible to allow the coupling element to be removably connectable to the inner conductor.

The coupling between the coupling element 124 and the inner conductor 114 is either capacitive, inductive or a combination therefore. This is achieved by providing a thin insulating layer on at least the surface portions of the snap on fingers 151 which are in abutment with the inner conductor, or on the whole coupling element or snap on finger portion thereof. In other embodiments, the inner conductor 114, or at least the recessed portion 152 thereof, comprises a thin insulating layer, while the snap on fingers do not. The insulating layer may have thickness of less than 50 μm, such as from 1 μm to 20 μm, such as from 5 μm to 15 μm, such as from 8 μm to 12 μm. In other embodiments, both the snap on fingers and the recessed portion comprise a thin insulating layer. The thin insulating layer could be provided by applying a thin layer of a polymer material, or by having a thin oxide layer, or by some other provisions applying an isolating layer.

It is understood that the alternative embodiment shown in FIG. 19 and described above only differs in the above described details relating to the interconnection between the coupling element and the inner conductor. Apart from this, the description above relating to FIGS. 5 and 15-16 applies analogously to this embodiment.

The description above and the appended drawings are to be considered as non-limiting examples of the invention. The person skilled in the art realizes that several changes and modifications may be made within the scope of the invention. For example, the number of coaxial lines may be varied, the number of radiators or dipoles may be varied, the number of coaxial lines provided with rail elements may be varied, the number of coaxial lines provided with dielectric elements and/or support elements may be varied, and the shape of the support element(s) and dielectric element(s) may be varied. Furthermore, the reflector does not necessarily need to be formed integrally with the coaxial lines, but may on the contrary be a separate element. The scope of protection is determined by the appended patent claims.

The invention claimed is:

1. An antenna feeding network for a multi-radiator antenna, said feeding network comprising a first inner conductor;

a first outer conductor formed by the walls defining a first elongated compartment filled essentially by air;

a rail element arranged inside the walls of the first elongated compartment; and and at least one dielectric element attached to the rail element and longitudinally movable within the first elongated compartment.

2. The antenna feeding network according to claim 1, wherein the walls are made in a conductive material.

3. The antenna feeding network according to claim 1, further comprising a second inner conductor;

a second outer conductor formed by the walls defining a second elongated compartment filled essentially by air; and a connector device indirectly interconnecting the first and second inner conductors.

4. The antenna feeding network according to claim 3 wherein the indirect interconnection provided by the connector device is a capacitive coupling.

5. The antenna feeding network according to claim 3 wherein the indirect interconnection provided by the connector device is an inductive coupling.

6. The antenna feeding network according to claim 3 wherein the indirect interconnection provided by the connector device is a combination of capacitive and inductive coupling.

7. A multi radiator antenna comprising:

an electrically conductive reflector, at least one radiating element arranged on said reflector and an antenna feeding network, said radiating elements being connected to said antenna feeding network, and said antenna feeding network comprising:

a first inner conductor;

a first outer conductor formed by the walls defining a first elongated compartment filled essentially by air;

a rail element arranged inside the walls of the first elongated compartment; and and at least one dielectric element attached to the rail element and longitudinally movable within the first elongated compartment.

8. The multi radiator antenna of claim 7 wherein the walls are made in a conductive material.

9. The multi radiator antenna of claim 7, wherein said antenna feeding network further comprises:

a second inner conductor;

a second outer conductor formed by the walls defining a second elongated compartment filled essentially by air; and a connector device indirectly interconnecting the first and second inner conductors.

10. The multi radiator antenna of claim 9 wherein the indirect interconnection provided by the connector device is a capacitive coupling.

11. The multi radiator antenna of claim 9 wherein the indirect interconnection provided by the connector device is an inductive coupling.

12. The multi radiator antenna of claim 9 wherein the indirect interconnection provided by the connector device is a combination of capacitive and inductive coupling.

* * * * *